US009184530B2

(12) United States Patent
Cohen

(10) Patent No.: US 9,184,530 B2
(45) Date of Patent: Nov. 10, 2015

(54) DIRECT CONNECT ORTHOGONAL CONNECTION SYSTEMS

(71) Applicant: Amphenol Corporation, Wallingford Center, CT (US)

(72) Inventor: Thomas S. Cohen, New Boston, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

(21) Appl. No.: 14/050,282

(22) Filed: Oct. 9, 2013

(65) Prior Publication Data

US 2014/0099844 A1 Apr. 10, 2014

Related U.S. Application Data

(60) Provisional application No. 61/712,141, filed on Oct. 10, 2012.

(51) Int. Cl.
*H01R 9/03* (2006.01)
*H01R 13/26* (2006.01)
(Continued)

(52) U.S. Cl.
CPC ..... *H01R 13/26* (2013.01); *H01R 13/03* (2013.01); *H01R 13/6473* (2013.01); *H01R 43/16* (2013.01); *H01R 4/023* (2013.01); *Y10T 29/49121* (2015.01)

(58) Field of Classification Search
CPC .. H01R 12/57; H01R 23/725; H01R 43/0256; H01R 9/091; H01R 31/06; H01R 23/025; H01R 31/065; H01R 2103/00; H01R 23/02; H01R 13/26; H01R 13/6588; H01R 23/688; H01R 13/65807; H01R 13/514; H01R 13/518; H01R 23/7073
USPC ..... 439/607.05–607.15, 626, 924.1, 924.2, 439/887
See application file for complete search history.

(56) References Cited

U.S. PATENT DOCUMENTS 8,398,431 B1 * 3/2013 Whiteman et al. ..... 439/607.06
2003/0203676 A1 10/2003 Hasircoglu
(Continued)

FOREIGN PATENT DOCUMENTS

KR 10-2002-0073527 A 9/2002

OTHER PUBLICATIONS

International Search Report and Written Opinion for PCT/US2013/064167, mailed Feb. 10, 2014.
(Continued)

*Primary Examiner* — Abdullah Riyami
*Assistant Examiner* — Thang Nguyen
(74) *Attorney, Agent, or Firm* — Wolf, Greenfield & Sacks, P.C.

(57) ABSTRACT

A direct-attach orthogonal electrical connection system with improved high frequency performance is provided. A conductive member is provided between first and second components, each having signal and ground conductors. The conductive member is electrically coupled to ground conductors of both the first and second components and may also have openings through which signal conductors of the first and second components may connect. As such, signal conductors may be positioned relative to the conductive member such that a uniform impedance is maintained along a signal path throughout the interconnection, reducing noise and reflections. The first-type conductive elements may be formed with multiple beams of different lengths to create multiple points of contact distributed along an elongated dimension. For example, a third beam may be fused to a mating portion to allow a tolerance for deviations in alignment between two directly attached connectors.

18 Claims, 9 Drawing Sheets

(51) Int. Cl.

| | |
|---|---|
| ***H01R 13/03*** | (2006.01) |
| ***H01R 43/16*** | (2006.01) |
| ***H01R 13/6473*** | (2011.01) |
| *H01R 4/02* | (2006.01) |

(56) References Cited

U.S. PATENT DOCUMENTS

| | | | | |
|---|---|---|---|---|
| 2006/0014433 | A1* | 1/2006 | Consoli et al. | 439/608 |
| 2007/0155149 | A1 | 7/2007 | Zhao et al. | |
| 2008/0214055 | A1* | 9/2008 | Gulla | 439/638 |
| 2009/0017681 | A1* | 1/2009 | Amleshi et al. | 439/608 |
| 2010/0015822 | A1* | 1/2010 | Morgan et al. | 439/83 |
| 2010/0291803 | A1* | 11/2010 | Kirk | 439/660 |
| 2012/0214344 | A1 | 8/2012 | Cohen et al. | |
| 2012/0242363 | A1* | 9/2012 | Breinlinger et al. | 324/756.02 |
| 2014/0057498 | A1* | 2/2014 | Cohen | 439/660 |

OTHER PUBLICATIONS

International Search Report and Written Opinion for PCT/US2013/064171, mailed Feb. 7, 2014.

* cited by examiner

DIRECT CONNECT ORTHOGONAL CONNECTION SYSTEMS

CROSS-REFERENCE TO RELATED APPLICATIONS AND CLAIM OF PRIORITY

This application claims the benefit of priority of U.S. Provisional Patent Application No. 61/712,141, filed on Oct. 10, 2012 and entitled "Direct Connect Orthogonal Connection Systems," hereby incorporated by reference in its entirety.

BACKGROUND

This disclosure relates generally to electrical interconnection systems and more particularly to high speed electrical connectors.

Electrical connectors are used in many electronic systems. It is generally easier and more cost effective to manufacture a system on several printed circuit boards ("PCBs") than to manufacture a system as a single assembly. Printed circuit boards are sometimes referred to as daughter boards or daughter cards, and are held in a card cage. Electrical connections are then established between the daughter cards.

A traditional arrangement for interconnecting daughter cards is to use a backplane. The backplane is a large PCB that contains signal traces that route electrical signals from one daughter card to another. The backplane is mounted at the back of the card cage assembly and the daughter cards are inserted from the front of the card cage. The daughter cards are parallel to each other and at right angles to the backplane.

For ease of assembly, the daughter cards are often connected to the backplane through a separable connector. Often, two-piece separable electrical connectors are used, where one connector is mounted to the daughter card, while another connector is mounted to the backplane. These connectors mate and establish numerous conducting paths. Sometimes, guide pins are attached to the backplane that guide the daughter card connector into proper alignment with the mating connector on the backplane.

Another traditional method for interconnecting daughter cards uses a midplane. In a midplane configuration, daughter cards are connected to both the front and the back of a large PCB, called the midplane. The midplane is typically mounted in the center of the card cage assembly, and daughter cards are inserted into both the front and the back of the card rack. The midplane is very similar to a backplane, but it has connectors on both sides to connect to daughter boards inserted from both the front and back of the assembly.

A further technique for interconnecting daughter cards is to directly connect orthogonal daughter cards without the use of a midplane. Electrical connectors are used to orthogonally interconnect the daughter cards, with each daughter card having a connector that mates with a connector of another daughter card.

The advantages of using a direct connect orthogonal configuration include flexibility of not being limited to a particular design of a midplane circuit board, better cooling due to absence of a midplane that can block airflow, and also reduced cost. However, using a direct connect orthogonal configuration also creates some challenges, including maintaining signal integrity when twisting internal signal conductors and ground conductors to interconnect two orthogonal daughter cards. Also a lack of a rigid physical support structure, such as a midplane or a backplane, that can provide mechanical alignment for the daughter cards can create challenges.

One of the difficulties in making a high density, high speed connector is that electrical conductors in the connector can be so close that there can be electrical interference between adjacent signal conductors. To reduce interference, and to otherwise provide desirable electrical properties, shield members may be placed between or around adjacent signal conductors. The shields are typically grounded conductors that prevent signals carried on one signal conductor from creating "crosstalk" on another signal conductor. The ground conductors also impact the impedance of each signal conductor, which can further contribute to desirable electrical properties.

Other techniques may be used to control the performance of a connector. Transmitting signals differentially can also reduce crosstalk. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector. Shielding in the form of ground conductors may be used between differential pairs.

Maintaining signal integrity can be a particular challenge in a direct connect orthogonal configuration. It is often desirable to have a uniform impedance throughout the path of a signal conductor, as abrupt changes in impedance may alter the signal integrity. However, the impedance of conductive elements, such as signal conductors and/or ground conductors, may be altered in the vicinity of changes in spacing between signal and ground conductors or other changes along the signal path. Such changes are difficult to avoid in a direct connect orthogonal connector in which the signal conductors need to be routed from a board to another orthogonal board.

Furthermore, at the mating interface, force must be generated to press conductive elements from the separable connectors together so that a reliable electrical connection is made between the two conductive elements. Frequently, this force is generated by spring characteristics of the mating portions in one of the connectors. For example, the mating portions of one connector may contain one or more members shaped as beams. As the connectors are pressed together, each beam is deflected by a mating contact, shaped as a post, pin or blade in the other connector. The spring force generated by the beam as it is deflected provides a contact force.

The need to generate mechanical force imposes requirements on the shape of the mating portions. For example, the mating portions must be large enough to generate sufficient force to make a reliable electrical connection. These mechanical requirements may preclude the use of shielding, or may dictate the use of conductive material in places that alters the impedance of the conductive elements in the vicinity of the mating interface. Because abrupt changes in impedance may alter the signal integrity of a signal conductor, mating portions are often accepted as being noisier portions of a connector.

SUMMARY

The inventors have recognized and appreciated techniques that may be used to improve signal integrity in a direct connect orthogonal connector. Such connectors may provide improved high speed, high density direct connect orthogonal interconnection systems. These techniques may be implemented in connectors using volume manufacturing techniques, leading to economical connection systems. These techniques may be used together, separately, or in any suitable combination in connectors for direct connect orthogonal interconnects or other connectors.

Some aspects relate to providing a connector for a direct orthogonal connection with a conductive member. The conductive member may be electrically coupled to ground conductors of first and second connectors and may also have openings through which signal conductors of the mated connector may pass. As such, signal conductors may be positioned relative to the grounded conductive member such that a uniform impedance is maintained along signal paths throughout the interconnection system, reducing noise and reflections.

Accordingly, in some aspects, the invention may be embodied as an electrical connector comprising a plurality of sets of conductive elements, each of the sets comprising first type conductive elements and second type conductive elements, and a conductive member comprising a plurality of openings therethrough. The first type conductive elements may pass through the openings and the second type conductive elements, may be electrically coupled to the conductive member. In some embodiments, the electrical connector may further comprise a plurality of insulative housings, wherein each of the plurality of sets of conductive elements may be at least partially disposed within an insulative housing of the plurality of insulative housings. The conductive member may comprise a unitary structure and each of the plurality of insulative housings may be mechanically coupled to the conductive member.

In some aspects, the invention may be embodied as a connector system comprising a first connector comprising a plurality of first type conductive elements and a plurality of second type conductive elements. Each of the first type conductive elements may comprise a mating portion. The second connector may comprise a plurality of third type conductive elements and a plurality of fourth type conductive elements, each of the third type conductive elements comprising a mating portion. The connector system may comprise a conductive member. The first type conductive elements, the second type conductive elements, the third type conductive elements, the fourth type conductive elements and the conductive member may be shaped and positioned such that, when the first connector and the second connector are mated, the mating portions of the first type conductive elements and the third type conductive elements mate to create a plurality of conductive signal paths passing through, but electrically insulated from, the conductive member. The second type conductive elements may be electrically coupled to the conductive member and the fourth type conductive elements may be electrically coupled to the conductive member.

In some embodiments, the first connector may be mounted to a first printed circuit board and the second connector may be mounted to a second printed circuit board. The first printed circuit board may be orthogonal to the second printed circuit board when the first connector and the second connector are mated.

In some embodiments, the first component may have a first plurality of signal conductors and a first plurality of ground conductors. The first plurality of ground conductors may be positioned relative to at least portions of the first plurality of signal conductors to provide first signal paths within the first component comprising the first plurality of signal conductors, each first signal path having a first impedance. The second component with a second plurality of signal conductors and a second plurality of ground conductors, the second plurality of ground conductors being positioned relative to at least portions of the second plurality of signal conductors to provide second signal paths within the second component comprising the second plurality of signal conductors, each second signal path having the first impedance.

In some aspects, a method of manufacturing an electrical connector may be provided, the method comprising stamping a plurality of lead frames, each lead frame comprising a plurality of first type conductive elements and a plurality of second type conductive elements. Subassemblies may be formed by forming insulative housings around portions of the plurality of lead frames. Portions of the first type conductive elements may be bent at a right angle. A plurality of the subassemblies may be aligned in parallel with the portions of the first type conductive elements of the plurality of the subassemblies disposed within a conductive member and the plurality of second type conductive elements of the plurality of the subassemblies electrically connected to the conductive member.

In some embodiments, the plurality of lead frames may comprise first-type lead frames and second-type lead frames. Aligning a plurality of the subassemblies in parallel may comprise alternating first-type lead frames with second-type lead frames in consecutive subassemblies, such that bent portions of the first-type conductive elements in the first-type lead frames are configured to bend in a direction opposite to that of bent portions of the first-type conductive elements in the second-type lead frames. In some embodiments, the bent portions of the first-type conductive elements in each of the first-type lead frames and the bent portions of the first-type conductive elements in an adjacent one of the second-type lead frames may be configured to bend towards each other.

Some aspects relate to providing signal conductors having at least three beams, one of which is shorter than the other two, to create multiple points of contact distributed along an elongated dimension. In some embodiments, a third beam may be fused to a mating portion to allow a tolerance for deviations in alignment between two directly connected connectors.

Accordingly, in some aspects, the invention may be embodied as electrical connector comprising a plurality of conductive elements, where each of the plurality of conductive elements may comprise a mating portion adjacent a distal end of the conductive element. The mating portion may comprise a first beam, a second beam parallel to the first beam, and a third beam shorter than the first and second beams. Each of the first, second, and third beams may comprise a mating surface. In some embodiments, each of the mating surfaces may be plated with gold.

In some embodiments, each of the first beam and the second beam may have a first thickness, the third beam may have a second thickness, and the second thickness may be different than the first thickness. In some embodiments, the second thickness may be less than the first thickness. For each of the plurality of conductive elements, the first beam and second beam may be integrally formed with a conductive member, and the third beam may be fused to the conductive member. In some embodiments, the third beam may be fused to the conductive member by brazing, welding, or soldering.

In some embodiments, the mating surface of the first beam may comprise a surface of a convex portion of the first beam. The mating surface of the second beam may comprise a surface of a convex portion of the second beam. The mating surface of the third beam may comprise a surface of a convex portion of the third beam. For each of the plurality of conductive elements, each of the plurality of conductive elements may comprise a distal end, and the convex portion of the first beam and the convex portion of the second beam may be a first distance from the distal end. The convex portion of the third beam may be a second distance from the distal end, and the second distance may be greater than the first distance. In some embodiments, the second distance may be greater than the first distance by at least 3 mm.

In some aspects, a method of manufacturing an electrical connector may be provided, the method comprising stamping a lead frame. The lead frame may comprise a plurality of first-type conductive elements. Each of the first-type conductive elements may comprise a mating portion, which may comprise at least one beam having a mating surface. Each of the first-type conductive elements may have attached to it a second type conductive element, and the second type conductive element may comprise at least one beam.

The foregoing is a non-limiting summary of the invention. Other advantages and novel features will become apparent from the following detailed description of various non-limiting embodiments of the present disclosure when considered in conjunction with the accompanying figures and from the claims.

DETAILED DESCRIPTION

Figure 1B:
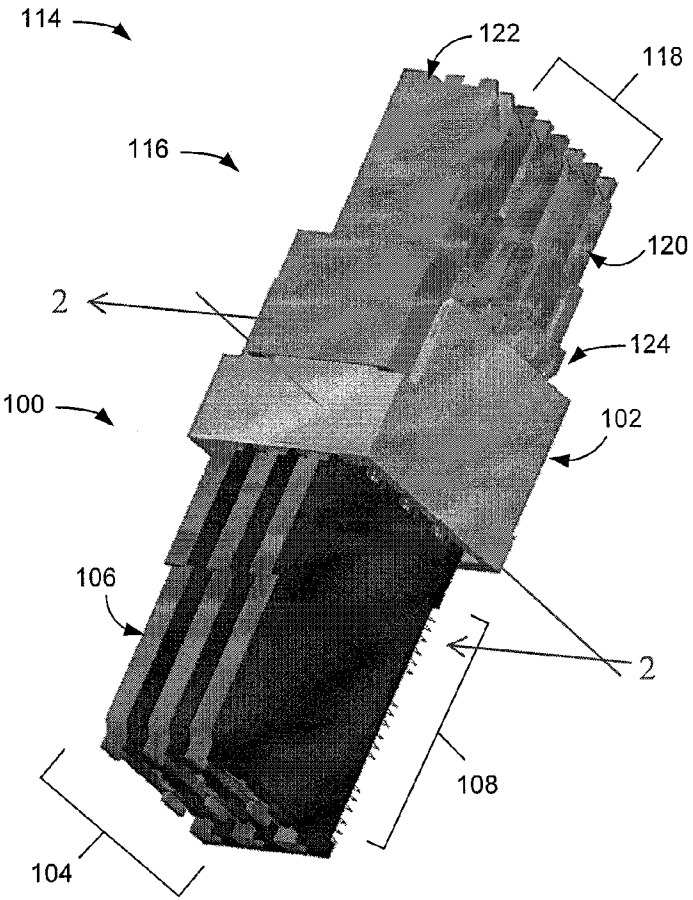
FIG. 1B is a perspective view of an illustrative direct connect orthogonal electrical interconnection system comprising a first-type connector mated with a second-type connector, in accordance with some embodiments.

The inventors have recognized and appreciated that various techniques may be used, either separately or in any suitable combination, to improve the performance of a high-speed interconnection system. These techniques may be particularly advantageous in a direct connect orthogonal interconnect system. They can be implemented using conventional manufacturing techniques, leading to economical connector designs. However, they can be applied in an orthogonal interconnect system in which the mechanical requirements of routing signal conductors through right angles in two dimensions has conventionally led to mechanical discontinuities impacting performance. Moreover, the inventors have recognized and appreciated techniques that compensate for performance issues that might otherwise arise from lack of mechanical support in a direct connect configuration without a midplane.

One such technique for improving performance of a high speed direct connect orthogonal electrical connector may entail providing an interconnection system that maintains substantially uniform transmission line properties throughout an orthogonal interconnection between two directly connected connectors. The inventors have recognized and appreciated that maintaining a uniform relative spacing between conductive elements and a ground reference is particularly challenging in a direct connect orthogonal architecture. In such configurations, conductive elements, such as signal conductors, may be folded three-dimensionally through the orthogonal interconnection structure. Such folding of conductive elements allows for low cost manufacture of the conductive elements by stamping all or some portion of the conductive elements of a column of conductive elements in the connector from a sheet of metal. The folding allows the mating surface of the conductive elements to be formed of material on a surface of the sheet. However, the folding may create difficulties in maintaining a uniform spacing with a ground reference, causing discontinuities in signal path impedance. The inventors have also recognized and appreciated that three-dimensional folding of conductive elements may require additional physical space and/or electrical components within the connector structure. Therefore, it may be desirable to provide a direct connect orthogonal connector that has a compact size while reducing the problems of noise and reflections.

An improved connector may be provided, for example, by appropriately positioning the signal paths relative to a ground reference through the interconnection structure. Such a ground reference may be provided partially by a conducting member to which ground conductors may connect. In some embodiments, intermediate portions of ground conductors may connect to the conducting member. Mating connector portions may be attached to or extend from another surface of the member.

In some embodiments, the conductive member may serve as a common ground reference for multiple ground conductors in the interconnection connector. The distance between first-type conductive elements, such as signal conductors, and a conductive member may be kept substantially uniform throughout the length of the interconnection. In some embodiments, the distance between first-type conductive elements and the conductive member is kept uniform between 0.1 mm and 1.5 mm. In some embodiments, the distance is kept uniform to within +/−20%. In some embodiments, the distance may be uniform to within +/−10% or +/−5%. This may serve to maintain constant transmission impedance, which may reduce crosstalk as signals travel along signal paths from one connector to a mated connector. For example, a uniform impedance throughout an interconnection may reduce the likelihood of reflections and noise caused by impedance discontinuities.

Accordingly, in some embodiments, a connection system may be provided that comprises first and second components, which may be portions of first and second direct connect orthogonal connectors. Each component may have signal and ground conductors. A conductive member provided between the two components, wherein the conductive member is electrically coupled to the ground conductors of both the first and second components. The conductive member may have openings through which signal conductors of the first and second components may interconnect. The signal conductors may be positioned relative to the conductive member such that signal paths through the conductive member have the same impedance as signal paths in the first and second components.

In some embodiments, the first component and the second component may be portions of a first and second connector, respectively. In some embodiments, the conductive member may be a part of the first connector. When connected to the second connector, the conductive member may serve as a ground adjacent portions of multiple signal paths within the interconnection system. In this manner, separate ground conductors may not need to be routed between the two connectors. This may reduce the overall size of the connector and simplify manufacture and assembly, while improving signal integrity by providing greater control over signal to ground spacing.

In some embodiments, an electrical connector may be manufactured by stamping out lead frames, each lead frame comprising conductive elements, such as signal conductors and/or ground conductors. In some embodiments, subassemblies may be formed by forming insulative housings around portions of the lead frames. Within the housing, ground conductors may run adjacent to portions of the signal conductors with an edge-to-edge spacing that impacts the impedance of the signal conductors. To reduce impedance discontinuities, in some embodiments the spacing between signal and adjacent ground conductors may be uniform over most or all of the portions of the signal conductors. In some embodiments, for example, the distance between adjacent signal and ground conductors may deviate +/−20% or less or, in other embodiments, +/−10% or less or +/−5% or less.

Subassemblies made in this way are sometimes called "wafers." For making an orthogonal connector, portions of the signal conductors and/or ground conductors may extend from the housing of a wafer and may be bent at a right angle. The wafers may be aligned in parallel so that the bent portions of the signal conductors are disposed within a conductive member, and the ground conductors are electrically connected to the conductive member. The signal conductors may extend through openings in the conductive member. These openings may be sized to provide a signal-to-ground spacing over the portions of the signal conductors passing through the conductive member to provide an impedance that matches the impedance in the wafer.

In some embodiments, the signal conductors may extend through the conductive member. The extending portions may include mating contacts of the signal conductors. Grounded, conductive elements may be positioned adjacent these portions of the mating contacts of the signal conductors, providing an impedance matching that of the impedance along the signal conductors within the wafers. In some embodiments, the grounded conductive elements may serve as mating contacts for ground conductors. These mating contacts may be electrically coupled through the conductive member to the ground conductors within the wafers. In this way, a relatively uniform impedance may be maintained along the signal conductors within the wafers, through the conductive member and into the mating interface.

Additionally or alternatively, an improved connector may be provided at the mating interface between two connectors by appropriately configuring mating portions of conductive elements. The mating interfaces may provide desirable electrical properties despite imprecision in relative mating positions of the mating connectors that results from direct connection without a midplane for additional rigidity.

Another technique for improving performance of direct connect orthogonal interconnections may entail providing a connector that has mating portions more tolerant of deviations in alignment when mating with another connector.

In some embodiments, mating portions of a first connector may be configured in such a manner that, when the first connector has a nominal mated position with respect to a second connector, an intended contact region of a first mating portion of a conductive element of the first connector is in electrical contact with a second mating portion of a conductive element of the second connector. In this nominal mated position, the contact region is at least a certain distance away from a distal end of the first mating portion. The portion of the first mating portion between the distal end and the intended contact region is sometimes referred to as a "wipe" region. Providing sufficient wipe may help to ensure that adequate electrical connection is made between the mating portions even if the first connector is not in the nominal mated position with respect to the second connector. Such misalignment may be the result of manufacturing or assembly tolerances. The inventors have recognized and appreciated that these tolerances may be particularly large in a direct connect orthogonal connector system because of the lack of a midplane to provide mechanical support to the connector system, leading to larger assembly tolerances.

The inventors have also recognized and appreciated that to provide adequate mating at a reasonable cost, a relatively large wipe region may be required, which would in turn form a relatively large unterminated stub. For example, the presence of such an unterminated stub may lead to unwanted resonances, which may lower the quality of the signals carried through the mated connectors. Such a stub has the potential to impact electrical performance. However, making the tolerances smaller may be relatively expensive. Therefore, to provide both economical manufacture and desirable signal integrity, particularly for high speed signals, it may be desirable to provide a simple, yet reliable, structure to reduce such an unterminated stub while still providing sufficient wipe to ensure adequate electrical connection.

The inventors have further recognized and appreciated that this challenge is exacerbated in a direct connect orthogonal connector. The amount of alignment deviation when directly connecting two connectors is often greater than the alignment deviation when connecting a connector to a rigid midplane or backplane. As a result, in a direct connect connector, the length of an unterminated stub can be almost twice as large as compared to a midplane or a backplane architecture. A longer unterminated stub can lead to lower resonant frequencies, which is more likely to interfere with signals that are transmitted through the mated connectors.

Accordingly, in some embodiments, additional mating surfaces may be provided on a mating portion such that deviations in mating alignment can be tolerated to provide a desired electrical connection. In some embodiments, an additional contact beam may be provided. This additional contact beam may be in addition to a dual-beam structure of a mating portion of a signal conductor.

In some embodiments, the additional beam may be a third beam providing a third mating surface. First and second mating surfaces may be adapted to reach an intended contact region on a first mating portion of a first connector. The third mating surface may be adapted to make electrical contact with the first mating portion at a location between the intended contact region and a distal end of the first mating portion. In this manner, a stub length is reduced when the first and second connectors are mated with each other, for example, to include only the portion of the first mating portion between the distal end and the location in electrical contact with the third mating surface of the second mating portion.

In some embodiments, the mating surfaces of contact beams may each be provided by a convex portion, such as a "bump" formed in the mating portion. In some embodiments, the convex portion of the third beam may be farther away from the distal end of the second mating portion than convex portions of the first and second beams. Furthermore, in some embodiments, the third contact beam may be fused onto lead frame by an appropriate technique, such as brazing, welding, and/or soldering. Fusing an additional beam to other contact beams allows different materials to be used for the additional beam than the other contact beams. The additional beam, for example, can be made of a thinner material, providing a more compliant beam. For example, the thickness of the first and second beams may be between 0.05 mm and 0.7 mm. In some embodiments, the thickness of the third beam may be between 20% and 80% of the thickness of the first and second beams. In some embodiments, the third beam may have a thickness between 40% and 60% of the thickness of the first and second beams. Such an arrangement may increase the likelihood that the additional beam and the other contact beams all make electrical connection to a mating contact.

Such techniques may be used alone or in any suitable combination, examples of which are provided in the exemplary embodiments described below.

Figure 1A:
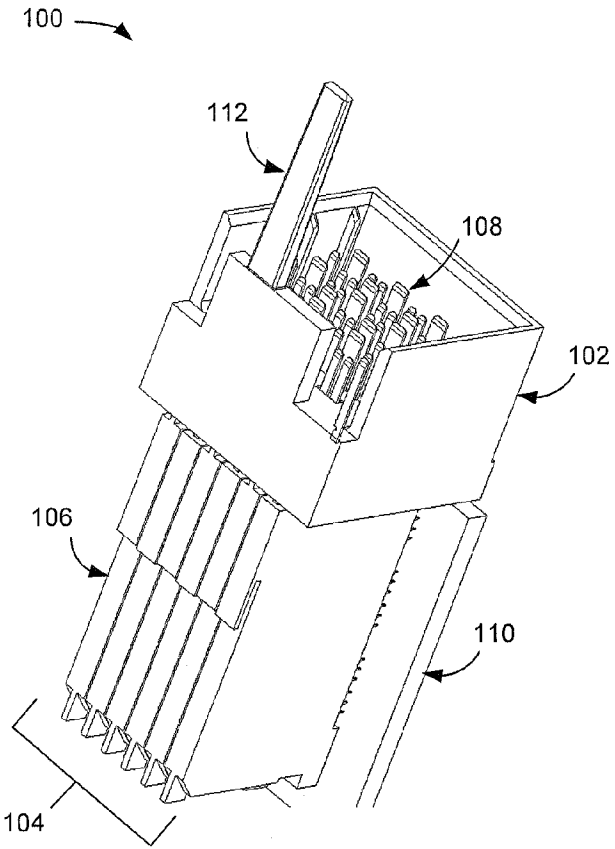
FIG. 1A is a perspective view of an illustrative first-type direct connect orthogonal electrical connector, in accordance with some embodiments.

FIG. 1A is a perspective view of an illustrative first-type direct connect orthogonal electrical connector 100, in accordance with some embodiments. The first type connector 100 may be attached to a daughter card installed in an electronic system with daughter cards in an orthogonal configuration. In such a system, a first portion of the daughter card may be inserted from a front side of the system and a second portion of the daughter cards may be inserted from the back side of the system. The daughter boards of the second portion may be mounted orthogonally to the daughter boards of the first portion.

Connectors of the first type may be attached to the boards of either the first portion or the second portion. A first type connector may be attached to each daughter board where that daughter board is to be connected to another, orthogonal daughter board of the other portion. Boards of the other portion may have a second type connector, which mates with connectors of the first type. Though not a requirement, the first type connector may have a mating interface similar to a conventional backplane connector module and the second type connector may be configured as a conventional daughter card connector.

In the illustrated embodiment, first-type connector 100 comprises conductive member 102, which can be made out of any suitable conductive material, such as a die-cast metal. In some embodiments, conductive member 102 may comprise a unitary structure, for example, being formed from a single metal member, such as by die casting or pressing metal powders into the desired shape. It should be appreciated, however, that in other embodiments, the conductive member 102 may comprise multiple stampings and/or multiple components, as the present disclosure is not limited in this regard. Moreover, it is not a requirement that the conductive member be formed of metal. Plastic that is filled or coated with conductive particles may alternatively or additionally be used to form conductive member 102.

In some embodiments, the conductive member 102 may be mechanically coupled to a plurality of "wafers". In the example of FIG. 1A, the conductive member 102 is mechanically coupled to six wafers 104 with insulative housings, of which insulative housing 106 is labeled. It should be appreciated, however, that the exact number of wafers coupled to the conductive member 102 is not critical to the present disclosure, and any suitable number may be used.

The insulative housing 106 may be, for example, a housing for a wafer containing a column of conductive elements. The housing may be partially or totally formed of an insulative material. Such a wafer may be formed by insert molding insulative material around conductive elements. If conductive or lossy material is to be included in the housing, a multi-shot molding operation may be used, with the conductive or lossy material being applied in a second or subsequent shot after insulative material is molded.

As explained in greater detail below in connection with FIG. 2, some conductive elements in each wafer 104 may be first-type conductive elements, such as those adapted for use as signal conductors. Some other conductive elements may be second-type conductive elements, such as those adapted for use as ground conductors. The ground conductors may be employed to reduce crosstalk between signal conductors or to otherwise control one or more electrical properties of the first-type connector 100. The ground conductors may perform these functions based on their shape and/or position within a column of conductive elements within the wafers 104 or based on their position within an array of conductive elements formed when multiple wafers 104 are arranged side-by-side.

The signal conductors may be shaped and positioned to carry high speed signals. The signal conductors may have characteristics over the frequency range of the high speed signals to be carried by the conductor. For example, some high speed signals may include frequency components of up to 12.5 GHz (or greater in some embodiments), and a signal conductor designed for such signals may present a substantially uniform impedance of 50 Ohms+/−10% at frequencies up to 12.5 GHz. Though, it should be appreciated that these values are illustrative rather than limiting. In some embodiments, signal conductors may have a nominal impedance of 85 Ohms or 100 Ohms, with a variation of +/−10% or, in some embodiments, tighter tolerances, such as +/−5%. Also, it should be appreciated that other electrical parameters may impact signal integrity for high speed signals. For example, uniformity of insertion loss over the same frequency ranges may also be desirable for signal conductors, which may also be improved by techniques as described herein.

The different performance requirements may result in different shapes of the signal and ground conductors. In some embodiments, ground conductors may be wider than signal conductors. In some embodiments, a ground conductor may be coupled to one or more other ground conductors while each signal conductor may be electrically insulated from other signal conductors and the ground conductors. Also, in some embodiments, the signal conductors may be positioned in pairs to carry differential signals whereas the ground conductors may be positioned to separate adjacent pairs.

In the embodiment illustrated in FIG. 1A, within each of the wafers the conductive elements are disposed within a plane that extends perpendicular to printed circuit board 110. These conductive elements may be a first type and a second type, which may serve as signal and ground conductors, respectively. In the embodiment illustrated, the first type conductive elements may pass through conductive member 102. In contrast, the second type conductive elements, though they may be electrically connected to conductive member 102, may not pass through conductive member 102.

In the example of FIG. 1A, a plurality of conductive elements, of which conductive element 108 is labeled, are illustrated as extending through a surface of the conductive member 102. Some of these conductive elements may be first-type conductive elements, such as signal conductors, that extend from within the insulative housing 106 and pass through a surface of the conductive member 102. Other conductive elements may be third-type conductive elements that are attached to the surface of the conductive housing and are electrically coupled to second-type conductive elements, such as ground conductors, in the insulative housing 106 through conductive member 102.

Regardless of the exact nature of these conductive elements that protrude from the surface of conductive member 102, these conductive elements may comprise mating portions, which are adapted to mate with corresponding conductive elements of a mated connector. In the illustrated embodiment, the mating portion of conductive element 108 is in the form of a blade, although other suitable contact configurations may also be employed, as aspects of the present disclosure are not limited in this regard. Other mating portions are similarly shaped as blades. Though, as illustrated some of the blades are wider than others. The wider blades may be designated for use as ground conductors and narrower blades may be designated for use as signal conductors.

In some embodiments, conductive elements, such as conductive element 108, may extend below the surface of conductive member 102 and into one of the insulative housing 106. Therein, the conductive elements may pass through the insulative housing and emerge from the other end of the insulative housing as contact tails. These contact tails may attach to a printed circuit board, such as printed circuit board 110. For example, the contact tails may be in the form of press fit, "eye of the needle," compliant sections that fit within via holes on the printed circuit board 110. However, other configurations may also be suitable for connecting wafers 104 with a printed circuit board 110, including, but not limited to, surface mount elements, spring contacts, solder balls, and solderable pins, as aspects of the present disclosure are not limited in this regard.

In the embodiment illustrated the mating contacts have broad dimensions that are perpendicular to major surfaces of wafers 104. When the mating contacts are stamped from the same conductive sheet as the conductive elements within the wafers, this configuration may be achieved by folding that sheet through a 90° angle.

In some embodiments, the first-type connector 100 may have an alignment guide that aids in mating with another connector, and/or that provides structural support for the interconnection. For example, FIG. 1A illustrates an alignment pin 112 that is attached to the conductive member 102. The alignment pin may be tapered, beveled or otherwise shaped to facilitate alignment of connectors during mating. The alignment pin 112 may be insertable into a corresponding opening in a housing in another connector. The opening may be chambered, beveled or otherwise shaped to facilitate alignment. However, it should be appreciated that the present disclosure is not limited to any particular structure of alignment guides, and in general, first-type connector 100 may have any suitable structure for aiding in the alignment of an interconnection.

FIG. 1B is a perspective view of an illustrative direct connect orthogonal electrical interconnection system 114 comprising a first-type connector 100 mated with a second-type connector 116, in accordance with some embodiments. In some embodiments, the second-type connector 116 may include a plurality of wafers 118, each with an insulative housing 120, which may have conductive elements passing through it. In the embodiment illustrated in FIG. 1B, the second-type connector 116 comprises six wafers 118. The second-type connector 116 is mated orthogonally with the first-type connector 100. As a result, insulative housings 118 of the second-type connector 116 are aligned at right angles with the insulative housings 104 of the first-type connector 100.

Any suitable mechanism may be used to hold the wafers of connector 116 together. In the example illustrated, each of the wafers of connector 116 is inserted into front housing portion 124. Though not visible in the orientation depicted in FIG. 1B, front housing portion 124 may contain multiple cavities aligned to receive mating contacts portions of the conductive elements within the wafers forming connector 116. Those cavities may be aligned to receive the mating portions of connector 100. In this way, when front housing portion 124 is inserted into the conductive member 102, the mating portions of the conductive members of the two connectors will mate within front housing portion 124.

In some embodiments, the second type connector 116 may have an alignment mechanism, such as a guide block 122, to assist in aligning the connection with the first-type connector 100. In the example of FIG. 1B, the guide block 122 can be configured to accept the guide pin 112 shown in FIG. 1A. In some embodiments, the guide block 122 may be formed as part of or attached to front housing portion 124.

While examples of specific arrangements and configurations are shown in FIG. 1A and FIG. 1B and discussed above, it should be appreciated that such examples are provided solely for purposes of illustration, as various inventive concepts of the present disclosure are not limited to any particular manner of implementation. For example, it is not a requirement that the first-type and second-type connectors have the same number of wafers. Aspects of the present disclosure are not limited to any particular number of wafers in a connector, nor to any particular number or arrangement of signal conductors and ground conductors in each wafer of the connector. Moreover, though it has been described that conductive elements are attached via a conductive member, which may comprise metal components, the interconnection need not be through metal structures nor is it a requirement that the electrical coupling between conductive elements be fully conductive. Partially conductive or lossy members may be used instead or in addition to metal members. For example, the conductive member 102 may be made of metal with a coating of lossy material thereon or may be made entirely or partially from a suitable lossy material.

Any suitable lossy material may be used. Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally have an upper limit between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemens/meter to about $6.1\times10^7$ siemens/meter, preferably about 1 siemens/meter to about $1\times10^7$ siemens/meter and most preferably about 1 siemens/meter to about 30,000 siemens/meter. In some embodiments material with a bulk conductivity of between about 10 siemens/meter and about 100 siemens/meter may be used. As a specific example, material with a conductivity of about 50 siemens/meter may be used. Though, it should be appreciated that the conductivity of the material may be selected empirically or through electrical simulation using known simulation tools to determine a suitable conductivity that provides both a suitably low cross talk with a suitably low insertion loss.

Electrically lossy materials may be partially conductive materials, such as those that have a surface resistivity between 1 Ω/square and 106 Ω/square. In some embodiments, the electrically lossy material has a surface resistivity between 1 Ω/square and 103 Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. In such an embodiment, a lossy member may be formed by molding or otherwise shaping the binder into a desired form. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. Examples of such materials include LCP and nylon. However, many alternative forms of binder materials may be used. Curable materials, such as epoxies, may serve as a binder. Alternatively, materials such as thermosetting resins or adhesives may be used.

Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer to form all or part of the housing. In some embodiments, the preform may adhere through the adhesive in the preform, which may be cured in a heat treating process. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a lossy member may be manufactured by stamping a preform or sheet of lossy material. Though, other materials may be used instead of or in addition to such a preform. A sheet of ferromagnetic material, for example, may be used.

Though, lossy members also may be formed in other ways. In some embodiments, a lossy member may be formed by interleaving layers of lossy and conductive material, such as metal foil. These layers may be rigidly attached to one another, such as through the use of epoxy or other adhesive, or may be held together in any other suitable way. The layers may be of the desired shape before being secured to one another or may be stamped or otherwise shaped after they are held together.

In the embodiment illustrated, the conductive elements in each of the wafers in connectors 100 and 116 are stamped as a lead frame from a sheet of metal, using stamping techniques as are known in the art. Curves, bends, folds and other shapes may be formed into the lead frame. For example, a contact portion may be created by forming a curved portion in the lead frame. Using conventional manufacturing techniques, the contact portion is created on the surface of the sheet from which the lead frame was stamped. Forming the contact portions in this way provides a smooth contact surface and, in some embodiments, allows a coating, such as gold, to be simply deposited on the contact surfaces.

As can be seen in FIG. 1A, each of the wafers in connector 100 has a housing 106 that is generally planar in a direction perpendicular to printed circuit board 110 to which the wafers are mounted. Within these housings 106, the lead frame is held such that the surfaces formed from the surface of the sheet from which the lead frame is stamped are positioned in the plane of the wafer, which is perpendicular to printed circuit board 110. However, as can also be seen in FIG. 1A, the mating portions exposed within conductive member 102 have their broad sides arranged in rows that run perpendicular to the orientation of the wafers. To form conductive elements that run continuously through the wafers and continue, with mating contact portions extending through conductive member 102 in the orientation illustrated, those conductive elements must be twisted at a 90° angle. Such a twist allows the broad sides of the conductive elements within conductive member 102 to be perpendicular to the broad sides of the same conductive elements within the wafers of connector 100.

Figure 2:
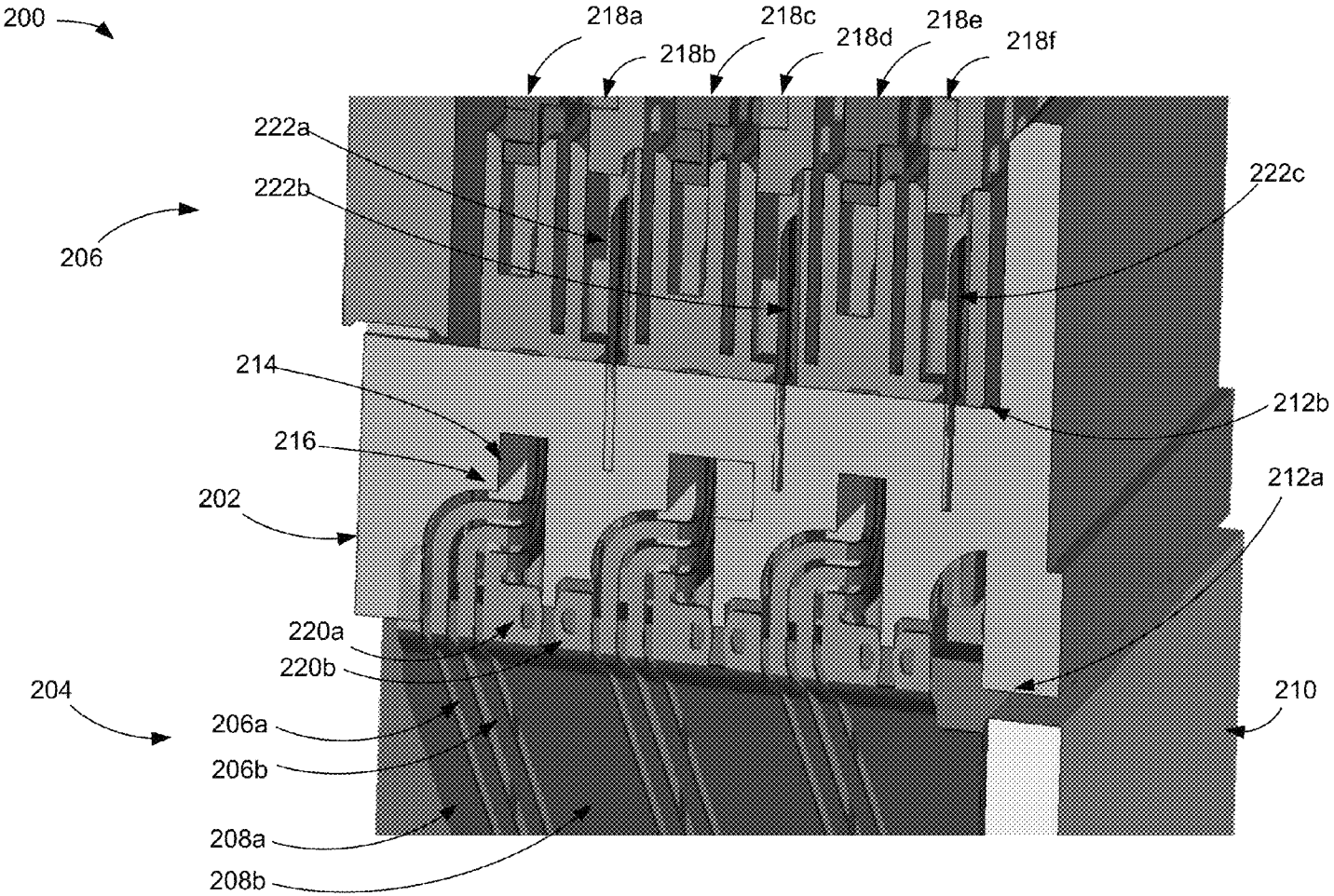
FIG. 2 is an enlarged view, partially cut away, of a conductive member in the direct connect orthogonal interconnection system of FIG. 1B, shown taken along the line 2-2 in FIG. 1B, in accordance with some embodiments.

An approach for forming conductive elements with such a twist, while preserving the edge to edge spacing between conductive elements acting as signal conductors and an adjacent ground, is shown in FIG. 2. FIG. 2 is an enlarged view, partially cut away, of a region 200 in a direct connect orthogonal interconnection system, in accordance with some embodiments. In this view, a conductive member 202 is shown in a cut-away view to illustrate the configuration of conductive elements within the region between two connectors, such as a first-type connector 204 and a second-type connector 206. First type connector 204 may represent a connector in the form of connector 100. Second type connector 206 may represent a connector in the form of connector 116. However, the specific configuration of the first type of second type connectors 204 and 206 is not critical to the invention.

The first type connector 204 has a plurality of subassemblies, sometimes called "wafers," that may comprise insulative housings. An example of a wafer forming connector 204 is shown in FIG. 2 in a cutaway broad-side view to reveal the conductive elements within the insulative housing of the wafer. In some embodiments, the first-type connector 204 may have a plurality of wafers aligned in parallel as illustrated in FIG. 1A but only one such wafer is visible in the view of FIG. 2.

As shown, the conductive elements of the illustrated wafer may comprise first-type conductive elements, of which 206*a* and 206*b* are labeled, which may be signal conductors in some embodiments. Some other conductive elements may be second-type conductive elements, of which of which 208*a* and 208*b* are labeled, which may be ground conductors in some embodiments. The first-type conductive elements 206*a* and 206*b* may form a differential pair of signal conductors that carry electrical signals, while the second-type conductive elements 208*a* and 208*b* may provide shielding between the pairs of signal conductors and, based on the edge-to-edge spacing between signal conductors and ground conductors, may establish the impedance of the signal conductors. Such second-type conductive elements 208*a* and 208*b*, in operation, may server as ground conductors and may have a voltage that is at earth ground, or positive or negative with respect to earth ground, as any voltage level may be used as a reference level.

The first-type connector 204 may connect with a printed circuit board 210, to create connections from the signal conductors and ground conductors to signal traces and ground planes in the printed circuit board 210. Similarly, conductive elements in the second-type connector 206 may be coupled to traces, ground planes, and/or other conductive elements within another printed circuit board (not shown in FIG. 2). When the first type connector 204 and the second type connector 206 mate, the conductive elements in the two connectors complete electrically conducting paths between the conductive elements within the two printed circuit boards.

In the region 200 illustrated in FIG. 2, some conductive elements from the first-type connector 204 may enter a first surface 212*a* of the conductive member 202 and exit through a second, opposing surface 212*b*. In some embodiments, a plurality of openings, such as opening 214, may be provided within the conductive member 202. The opening 214 may, for example, allow signal conductors to pass through the conductive member 202 and mate with conductive elements from the second type connector 206. In some embodiments, the openings 214 may be partially or totally filled with insulative material (not shown) that holds conductive members acting as signal conductors away from conductive member 202. Though, it should be appreciated that air may act as an insulator such that it is not critical that there be a discrete spacer or other member within openings 214.

In some embodiments, first-type conductive elements 206*a* and 206*b*, which may be signal conductors, may extend into the first surface 212*a* of conductive member 202 by bending through a three-dimensional fold, such as fold 216.

In some embodiments, after bending through the fold 216, signal conductors may extend and protrude through the second surface 212*b* of the conductive member 202. The signal conductors may have mating portions (not visible in FIG. 2) that may mate to corresponding mating portions of conductive elements extending from insulative housings of wafers in the second type conductor 206. The example of FIG. 2 shows six wafers, 218*a*, 218*b*, 218*c*, 218*d*, 218*e*, and 218*f* in cross-section. In FIG. 2, the pair of first-type conductive elements 206*a* and 206*b*, pass through openings in the conductive member 202 and mate with conductive elements in wafer 218*a* in the second type connector 206. The other two pairs of signal conductors in FIG. 2 (not labeled) may also pass through the conductive member 202 and mate with signal conductors of wafers 218*c* and 218*e*, respectively, in the second-type connector 206.

Though the mating contact from wafers 218*a*, 218*c* and 218*e* are not visible in the plane depicted in cross-section in FIG. 2, that mating will be adjacent mating of ground conductors.

In the cross-section depicted in FIG. 2, ground conductors 222*a*, 222*b* and 222*c*, extend from conductive member 202. Those ground conductors 222*a*, 222*b* and 222*c* mate with mating contact portions (not numbered) extending from wafers 218*b*, 218*d* and 218*f*.

This organization of mating contacts creates alternating rows of mating contacts of different configurations. As a result, in the embodiment illustrated, mating contacts of pairs of signal conductors in one row are adjacent mating contacts of ground conductors in an adjacent row as well as within the same row.

The other three wafers, 218*b*, 218*d*, 218*f*, may have conductive elements that are coupled to folded signal conductors buried deeper inside the conductive member 202 (not shown in FIG. 2). For example, there may be additional wafers stacked below the lead frame shown in the first type connector 204 of FIG. 2. In the embodiment illustrated, each of those wafers may similarly have three pairs of folded signal conductors that mate with signal conductors from three of the wafers in the second type connector 206. As such, each of the conductive elements in the wafers of second type connector 206 may be connected to signal conductors from the first type connector 204 to provide electrical signal paths through the interconnection.

Second-type conductive elements 208*a* and 208*b*, which may be ground conductors, from the first type connector 204 may also be three-dimensionally folded into the conductive member 202. However, in contrast to the signal conductors, which pass through openings from the first surface 212*a* to the second surface 212*b*, some or all of the ground conductors may be electrically coupled directly to the conductive member 202, with or without being folded and with or without passing all the way through. For example, FIG. 2 shows an example of a ground conductor 208*b* electrically coupled to the conductive member 202 at the first surface 212*a* via ground attachments, such as ground clips 220*a* and 220*b*. Ground clip 220*a* then extends into a folded portion of the conductive element that enters into an opening 214 of the first surface 212*a* of the conductive member 202. In some embodiments, the folded portion of the ground conductor may then be electrically coupled to the conductive member 202 rather than extending through to second surface 212*b*. Moreover, conductive element 208*a* is shown without any folded portion. Rather, conductive element 208*a* extends into a sot or other suitable attachment feature within conductive member 202.

In some embodiments, conductive elements acting as ground conductors from connector 204 may not extend to the mating interface. In such embodiments, there may be a plurality of conductive elements, such as ground blades 222*a*, 222*b*, 222*c* that extend out from the second surface 212*b*. In some embodiments, the ground blades may be attached to the second surface 212*b* and have mating portions that are mated with mating portions of ground conductors from the wafers of the second type connector 206. Though, in other embodiments, ground blades may extend out from the second type connector 206 and may be insertable through holes in the second surface 212*b*.

In some embodiments, grounded portions of the interconnection system may be configured such that the impedance of signal paths passing from the first surface 212*a* to the second surface 212*b* remains substantially uniform throughout the interconnection region. For example, impedance may vary by no more than +/−10% over the length of the signal conductors within the wafers of the connectors and within conductive member 202.

This impedance may be maintained by providing a relatively uniform spacing between signal conductors and a ground structure. Within the wafers forming the connectors, the spacing relative to ground may be established by stamping the lead frame with elongated ground conductors running parallel to signal conductors within conductive member 202, and particularly in the vicinity of a three dimensional fold, the spacing between conductive members of the lead frame may not be maintained. However, a desired signal to ground spacing may be maintained by spacing the signal conductors relative to walls of the openings of conductive member 202 with the desired spacing. Because ground conductors are electrically coupled to conductive member 202, this configuration achieves a ground reference potential in the desired locations to provide a desired impedance along the length of the signal conductors.

In some embodiments, this impedance may be maintained in the mating interface region, too. For example, signal conductors passing through the openings may be spaced apart from the inner walls of the conductive member 202 at a distance that is substantially the same as the distance between first-type conductive elements 206*a*, 206*b* and second-type conductive elements 208*a* and 208*b*. The spacing between signal conductors may also be kept uniform throughout the mating contact region and even into the second connector 206. For example, the spacing may vary by no more than an amount between +/−10% over the length of the signal conductors within the wafers of the connectors and within conductive member 202. Such configurations may reduce the effect of undesired reflections and/or crosstalk, and improve signal integrity. Though, it should be recognized that, in some embodiments, a uniform impedance may be achieved with a non-uniform spacing between signal conductors and adjacent ground conductors. For example, the spacing within the wafers may be different than within conductive member 202, if the area between the signal conductors and adjacent grounds is occupied by material of different dielectric constants.

Although some examples of conductive elements and mating regions of conductive elements have been discussed in regards to FIG. 2, it should be appreciated that other suitable configurations may also be used. Regardless of the exact nature of mating portions and coupling between connectors and a conductive structure, a first type connector 204 and a second type connector 206 may be directly connected in an orthogonal manner via a conductive member 202 such that ground conductors in each connector are electrically connected through the body of the conductive member 202.

Figure 3A:
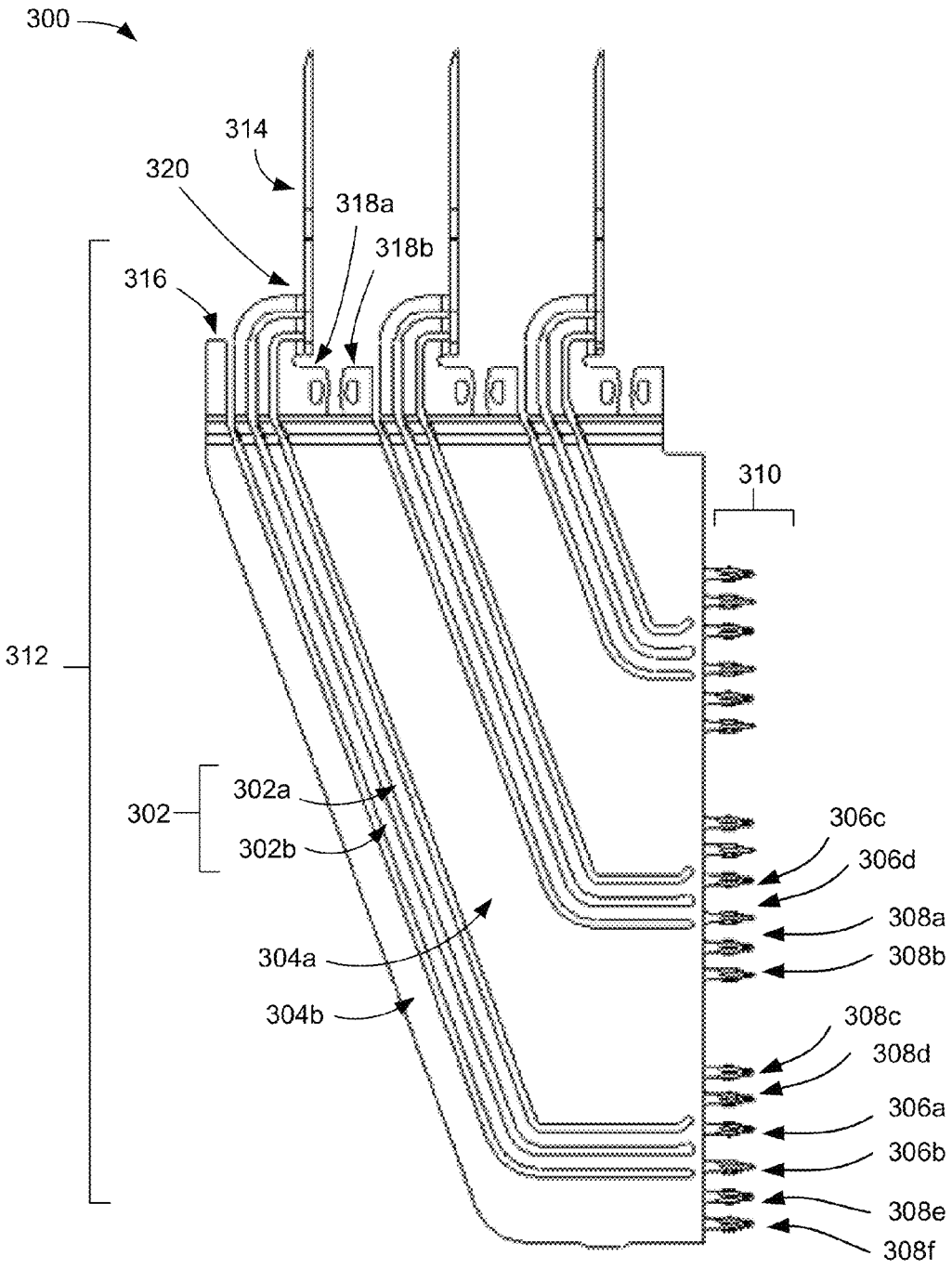
FIG. 3A is a top view from of an illustrative first first-type lead frame suitable for use in a wafer of the first-type connector of FIG. 1A, in accordance with some embodiments.

In the illustrated embodiment, each of the first and second type connectors has alternating columns or rows of conductive elements of different configurations such that pairs of signal conductors are adjacent ground conductors within the same row or column and within adjacent rows/columns, connectors of this type may be formed from two types of wafers assembled in an alternating pattern. FIG. 3A is a top view of an illustrative first first-type lead frame 300 suitable for use in a first-type wafer of the first-type connector (e.g., the wafer with insulative housing 106 in the first-type connector 100 shown in FIG. 1A), in accordance with some embodiments. In this example, the first first-type lead frame 300 includes a plurality of conductive elements, such as conductive elements 302*a*, 302*b*, 304*a* and 304*b*. For example, some conductive elements may be first-type conductive elements 302*a* and 302*b*, such as signal conductors forming a differential pair 302, while other conductive elements may be second-type conductive elements 304*a* and 304*b*, such as ground conductors.

In some embodiments, such a lead frame may be made by stamping a single sheet of metal to form the conductive elements, and may be enclosed in an insulative housing of a wafer suitable for use in a first-type connector. Some of the conductive elements, such as signal conductors 302*a* and 302*b*, may have a broad side and edges joining the broad sides, the broad sides being wider than the edges. In the example of FIG. 3A, the broad sides of signal conductors 302*a* and 302*b* are visible.

Each conductive element of the illustrative lead frame 300 may have one or more contact tails at one end, such as contact tails 306*a*, 306*b*, 306*c*, 306*d*, 308*a*, 308*b*, 308*c*, 308*d*, 308*e*, and 308*f*. As discussed above in connection with FIG. 1A, the contact tails may be adapted to be attached to a printed circuit board or other substrate (e.g., the printed circuit board 110 shown in FIG. 1A) to make electrical connections with corresponding conductive elements of the substrate.

In the embodiment shown in FIG. 3A, some conductive elements, such as first-type conductive elements 302*a*, 302*b*, may be adapted for use as signal conductors and are relatively narrow. As such, the first-type conductive elements 302*a* and 302*b* may have only one contact tail each, respectively, contact tail 306*a* and contact tail 306*b*.

In the embodiment shown in FIG. 3A, other conductive elements, such as second-type conductive elements 304*a* and 304*b*, are adapted for use as ground conductors and are relatively wide. As such, it may be desirable to provide multiple contact tails for each of the conductive elements 304*a* and 304*b*, such as contact tails 308*a*, 308*b*, 308*c*, and 308*d* for the second-type conductive element 304*a*, and contact tails 308*e* and 308*f* for the second-type conductive element 304*b*.

In some embodiments, the tails of first-type and second-type conductive elements may form a column 310 along the edge of the first first-type lead frame 300, as shown in FIG. 3A. Within this column 310, adjacent pairs of tail portions of signal conductors, such as tail pair 306*a*, 306*b* and tail pair 306*c*, 306*d*, may be separated by tails of ground conductors, such as tails 308*a*, 308*b*, 308*c*, and 308*d*. When multiple wafers are placed side-by-side (e.g., the plurality of wafers 104 in FIG. 1A), adjacent lead frames may create a plurality of parallel columns of contact tails of signal conductors separated by contact tails of ground conductors.

Each of the conductive elements may have an intermediate portion, illustrated in FIG. 3A as extending over the labeled region 312. The intermediate portion may extend from the contacts tails at one of the first first-type lead frame 300 to mating portions at the other end, such as mating portion 314. The mating portions may be adapted to make electrical connections to corresponding mating portions of a mating connector (e.g., the second type connector 116 shown in FIG. 1B) either directly or via a conductive member (e.g., conductive member 102 shown in FIG. 1A).

The intermediate portions for some conductive elements, such as first-type conductive elements 302*a* and 302*b*, may undergo a three-dimensional folding, such as a fold 320, before turning into a mating portion. In some embodiments, the mating portions may be in the shape of blades. For example, FIG. 3A shows edges of the mating portion 314 of conductive element 302*b* (an example of a broad side view of a mating portion blade will be illustrated in FIG. 3B). In the example of FIG. 3A, the mating portion of signal conductor 302*a* is hidden underneath the mating portion 314, due to the three-dimensional fold 320 (also illustrated below from a broad side view in FIG. 3B).

In some embodiments, the intermediate portions for other conductive elements, such as second-type conductive elements 304*a* and 304*b*, may not undergo any folding. In the example of FIG. 3A, the second-type conductive elements may have attachment features, such as attachment features 316, 318*a* and 318*b*, that attach directly to a conductive member, such as conductive member 202 in FIG. 2. For example, in some embodiments, an attachment feature 316 for ground conductor 304*b* may be electrically and/or mechanically coupled to a conductive member which, in turn, may be electrically coupled to ground conductors at a mated connector (e.g., the second-type connector 116 shown in FIG. 1B). Alternatively or additionally, attachment features, such as attachment features 318*a* and 318*b* of ground conductor 304*a*, may be ground clips that fasten onto portions of a conductive member It should be appreciated, however, that the ground conductors may have any suitable feature that may be bent, formed to create a compliant structure that presses against a conductive member when a wafer encompassing lead frame 300 is attached to the conductive member, or otherwise attached to the conductive member.

Although some examples of mating portions for signal conductors and attachment features for ground conductors have been discussed, it should be appreciated that the present disclosure is not limited in this regard, and other types of structures may also be suitable for signal conductors and/or ground conductors. Furthermore, although three pairs of signal conductors and three corresponding mating portions and attachment features are illustrated in FIG. 3A, it should be appreciated that the present disclosure is not limited in this regard, and other numbers of signal conductors and ground conductors, as well as corresponding mating portions, attachment features, and contact tails, may also be suitable.

Figure 3B:
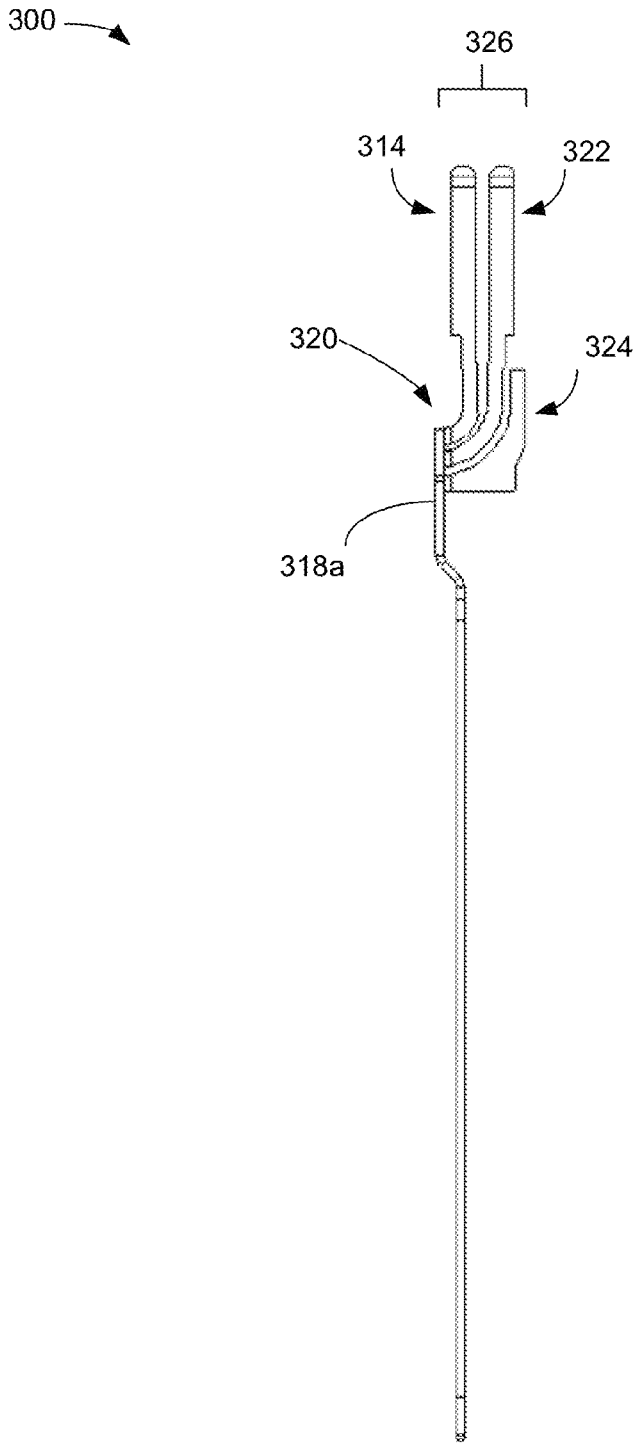
FIG. 3B is a side view of the illustrative first first-type lead frame 300 shown in FIG. 3A, in accordance with some embodiments.

FIG. 3B is a side view of the illustrative first first-type lead frame 300 shown in FIG. 3A, in accordance with some embodiments. In this view, the first first-type lead frame 300 is shown from the side, to illustrate a broad-side view of the mating portions, such as mating portion 314, of some conductive elements. For example, FIG. 3B illustrates a broad-side view of mating portion 314 corresponding to first-type conductive element 302*b* shown in FIG. 3A.

One or more signal conductors may have a fold, such as fold 320, that leads into mating portions, such as mating portions 314 and 322. In the example of FIG. 3B, mating portion 322 may correspond to the first-type conductive element 302*a* shown in FIG. 3A (which was hidden underneath mating portion 314 in FIG. 3A). As a result of such folding, a mating portion of a conductive element may be folded in an orthogonal manner relative to other parts of the conductive element, such as other parts of the intermediate portions or the contact tail. For example, FIGS. 3A and 3B illustrate mating portion 314 having a broad side that is orthogonal to the broad side of contact tail 306*b*.

In the embodiment illustrated, conductive elements in lead frame 300 acting as ground conductors, such as 304*a* and 304*b*, do not have mating contact portions comparable to mating contact portions 314 and 322 for the signal conductors. In a connector formed from wafers using a lead frame 300, additional conductive elements may be positioned adjacent mating contact portions 314 and 322 to provide a desired signal to ground spacing. Those additional conductive elements may be integrated into the connector in any suitable way, such as by electrically and mechanically attaching them to a conductive member 202 (FIG. 2). Those additional conductive elements may be shaped to form the mating contact portions for ground conductors.

In some embodiments, there may be additional attachment features of ground conductors, such as attachment feature 324. Attachment feature 324 may be configured to be electrically coupled to a conductive element, such as conductive element 304*a*, such that a spacing between a signal path and a ground reference is maintained at a uniform distance throughout the orthogonal interconnection. For example, the spacing between the pair of first-type conductive elements 302*a*, 302*b* and second-type conductive element 304*a* in FIG. 3A may be substantially the same as the spacing between the pair of signal conductor mating portions 326 and a ground attachment feature 324.

Although some examples have been provided in FIGS. 3A and 3B of an illustrative first first-type lead frame 300, it should be appreciated that other suitable configurations may be used to enable direct orthogonal connection between signal conductors from two connectors, with ground conductors being electrically connected via an intermediate conductive member.

Lead frame 300 may be used to form a first-type wafer. Lead frame 400 may also be used to form a second type wafer. FIG. 4A is a top view of an illustrative second first-type lead frame 400 suitable for use in a wafer of the first-type connector of FIG. 1A, in accordance with some embodiments. The second first-type lead frame 400 may be used in conjunction with the first first-type lead frame 300 shown in FIG. 3A. For example, in some embodiments, a first first-type lead frame 300 and a second first-type lead frame 400 may be used in alternating wafers placed side-by-side within a first-type connector.

Comparing the configurations of first-type lead frames 400 and 300, in the illustrative second first-type lead frame 400 shown in FIG. 4A, first-type conductive elements 402*a* and 402*b* and second-type conductive elements 404*a* and 404*b* are positioned differently relative to respective conductive elements in first first-type lead frame 300. As such, the corresponding mating portions, such as mating portion 406, of second first-type lead frame 400 are positioned differently relative to the mating portion 314 of the first first-type lead frame 300. In some embodiments, this may allow first first-type lead frame 300 and second first-type lead frame 400 to be placed in adjacent wafers without having their folded signal conductor mating portions physically interfere with each other.

Figure 4B:
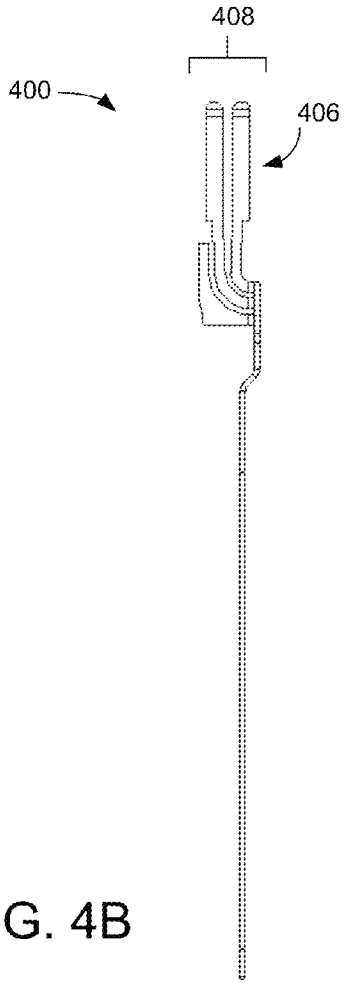
FIG. 4B is a side view of the illustrative second first-type lead frame 400 shown in FIG. 4A, in accordance with some embodiments.
Figure 4A:
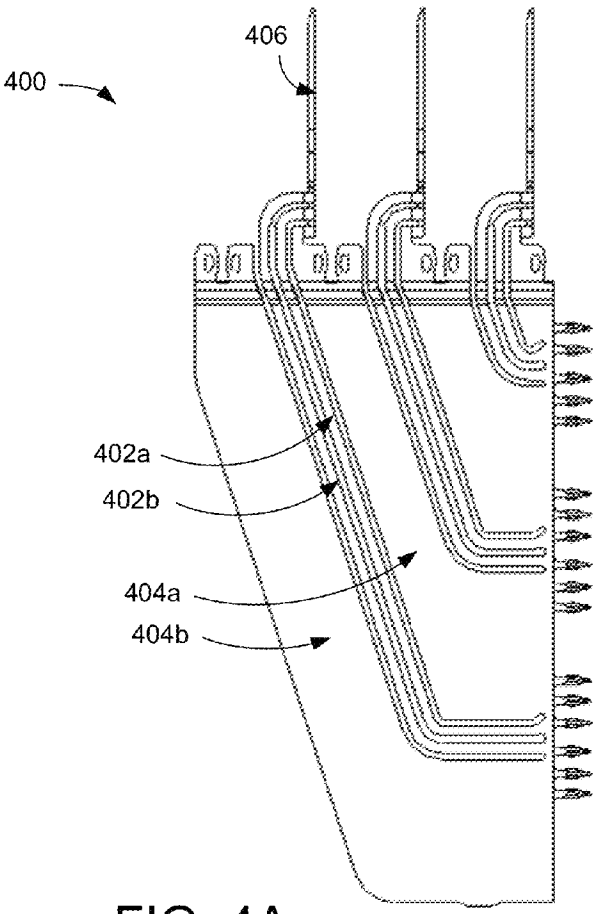
FIG. 4A is a top view of another example of an illustrative second first-type lead frame suitable for use in a wafer of the first-type connector of FIG. 1A, in accordance with some embodiments.

FIG. 4B is a side view of the illustrative second first-type lead frame 400 shown in FIG. 4A, in accordance with some embodiments. In this view, the second first-type lead frame 400 is shown from the side, to illustrate a broad-side view of mating portions, such as mating portion 406, of some conductive elements. For example, FIG. 4B illustrates a broad-side view of a pair of mating portions 408 corresponding to the pair of first-type conductive elements 402*a* and 402*b* shown in FIG. 4A.

As can be seen by a comparison of FIGS. 3B and 4B, mating portions 326 and 408 are folded, with respect to the intermediate portions of the conductive elements, in opposite directions. With such a configuration, when a wafer made with a lead frame 400 is placed to the right of a wafer made with a lead frame 300, the mating portions 326 and 408 of the adjacent wafers will be folded towards each other. These mating portions may thus be aligned in a direction perpendicular to their broadsides.

Though, it should be appreciated that alignment is not required. In some embodiments, the mating portions may be folded in the same direction such that they are offset by approximately the width of a wafer. In other embodiments, the mating portions may be folded towards each other but with alignment along a single line. Such a configuration is illustrated in FIG. 5.

Figure 5:
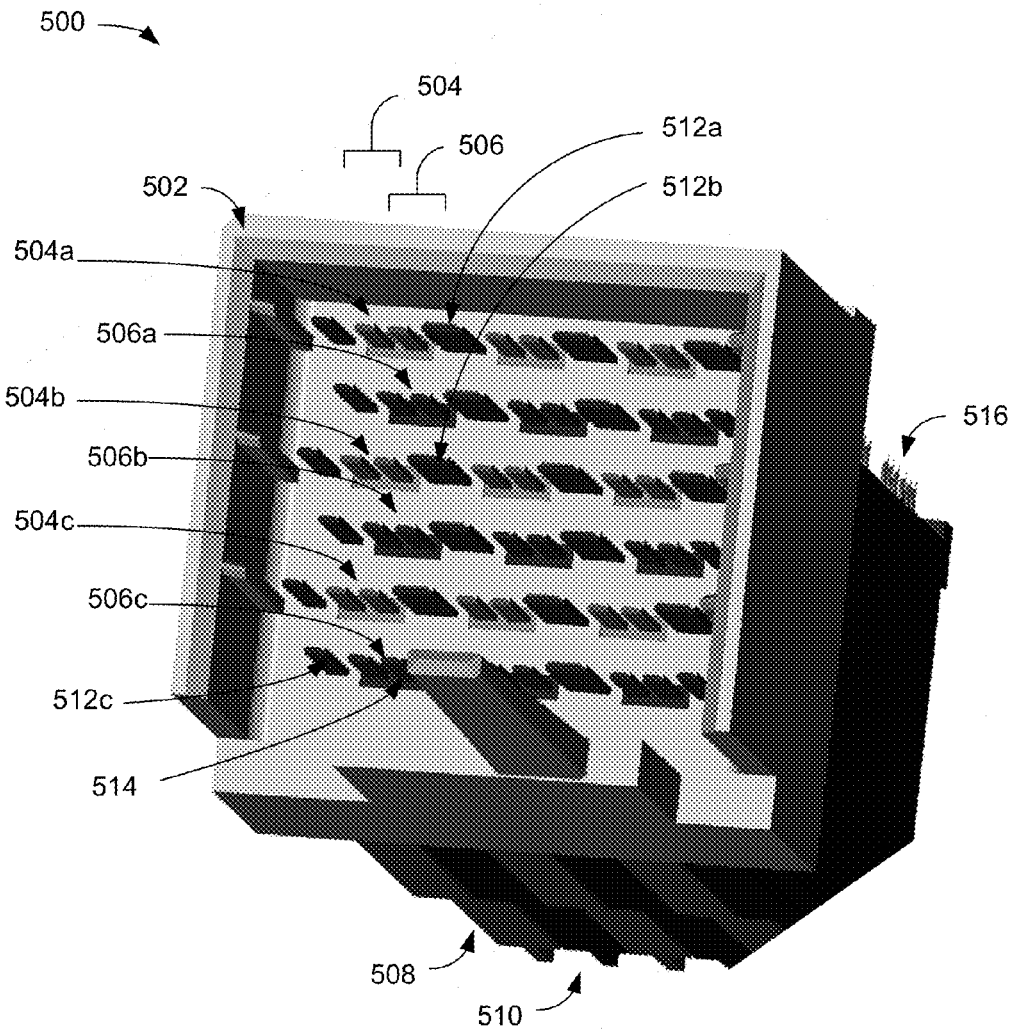
FIG. 5 is a perspective view of a mating region of the illustrative first-type connector shown in FIG. 1A, in accordance with some embodiments.

FIG. 5 is a perspective view of a mating region 500 in a conductive member 502 of a first-type connector, such as the illustrative first-type connector 100 (FIG. 1A) or connector 204 (FIG. 2), in accordance with some embodiments. In some embodiments, a first-type connector may include a plurality of conductive elements arranged in a plurality of parallel columns. For example, FIG. 5 shows a plurality of pairs of first-type conductive elements 504*a*, 504*b*, and 504*c*, which may be differential pairs of signal conductors, arranged in a first column 504. There may be a second column 506, parallel to the first column 504, but staggered in arrangement, comprising another plurality of differential pairs of first-type conductive elements 506*a*, 506*b*, and 506*c*, which may also be signal conductors.

Each column of signal conductor pairs may correspond to one of the wafers installed in the first-type connector (e.g., wafers having the plurality of insulative housings 118 in first-type connector 100 of FIG. 1B). In the example shown in FIG. 5, signal conductor column 504 may correspond to wafer 508, while signal conductor column 506 may correspond to adjacent wafer 510. In some embodiments, signal conductor pairs 504*a*, 504*b*, and 504*c* in column 504 may correspond to pairs of mating portions (e.g., mating pair 408 of FIG. 4B) of first-type lead frame 400, while signal conductors 506*a*, 506*b*, and 506*c* of column 510 may correspond to pairs of mating portions (e.g., mating pair 326 of FIG. 3B) of first-type lead frame 300. In some embodiments, the mating portions of signal conductors in first-type lead frame 300 may be folded in an opposite direction as the mating portions of signal conductors in first-type lead frame 400 (as illustrated in FIGS. 3B and 4B). In such embodiments, the signal conductor mating portions of first-type lead frame 300 and an adjacent lead frame 400, when arranged side-by-side in a connector, may fold towards each other.

In some embodiments, a plurality of third-type conductors, such as third-type conductors 512*a*, 512*b*, and 512*c* in FIG. 5, may be arranged between pairs of signal conductors in adjacent columns formed from the same type of first-type lead frame. The third-type conductors may be ground conductors. In some embodiments, these ground conductors may be metal blades that extend out from the surface of the conductive member 502. In some embodiments, the ground conductors may be separate pieces from conductive member 502 and from wafers, such as wafers 508 and 510. These ground conductors may be attached to conductive member 502 in any suitable way, including, for example, press fit segments or a friction or interference fit. Regardless of how attached, the ground conductors may be positioned such that mating portions of these ground conductors may be aligned with and insertable into cavities in a mating second-type connector (e.g., second-type connector 116 of FIG. 1B).

Alternatively or additionally, ground conductors may be physically attached to a second-type connector and insertable into holes in the surface of the conductive member 502. Regardless of how the ground conductors are coupled to the conductive member 502, a plurality of third-type conductors, such as third-type conductors 512*a*, 512*b*, 512*c*, may provide mating portions to couple the conductive member 502 with ground conductors in a second-type connector (e.g., second-type connector 116 of FIG. 1B).

In some embodiments, a plurality of insulative members may be disposed within the openings of the conductive member 502. These insulative members may electrically insulate the first-type conductive elements, such as signal conductors, from the conductive member 502. On the other hand, the ground conductors may be configured such that the ground conductors are electrically connected to conductive member 502. For example, FIG. 5 shows insulative member 514 surrounding the first-type conductive pair 506*c*. It should be appreciated, however, that the exact configuration of the insulative member is not critical to the present disclosure, and any suitable form of insulative member may be provided within openings of the conductive member to electrically insulate first-type conductive elements from the conductive member.

The wafers, such as wafers 508 and 510, may each have a plurality of contact tails, such as contact tails 516. These contact tails may couple with a printed circuit board (e.g., PCB 110 in FIG. 1A). The contact tails in each wafer may form a column of contact tails (e.g., column 310 in FIG. 3A) such that adjacent wafers may create a plurality of parallel columns of contact tails. These plurality of columns of contact tails and may be arranged such that they are orthogonal to the plurality of columns of signal and ground conductors, such as columns 504 and 506 in FIG. 5. As such, this may allow a printed circuit board connected to the contact tails of a second-type connector to be orthogonal to a printed circuit board connected to a first-type connector.

In the embodiment illustrated in FIG. 5, the mating contact portions of the conductive elements of connector 500 are shaped as blades. This shape is not critical to the invention. However, regardless of the shape of the mating contact portions, the connector to which connector 500 mates may contain conductive elements with mating contact portions that are complementary to the mating contact portions in connector 500. In this example, in which connector 500 has mating contact portions shaped as blades, the complementary contact portions may be compliant and may be shaped, for example, as beams.

Figure 6:
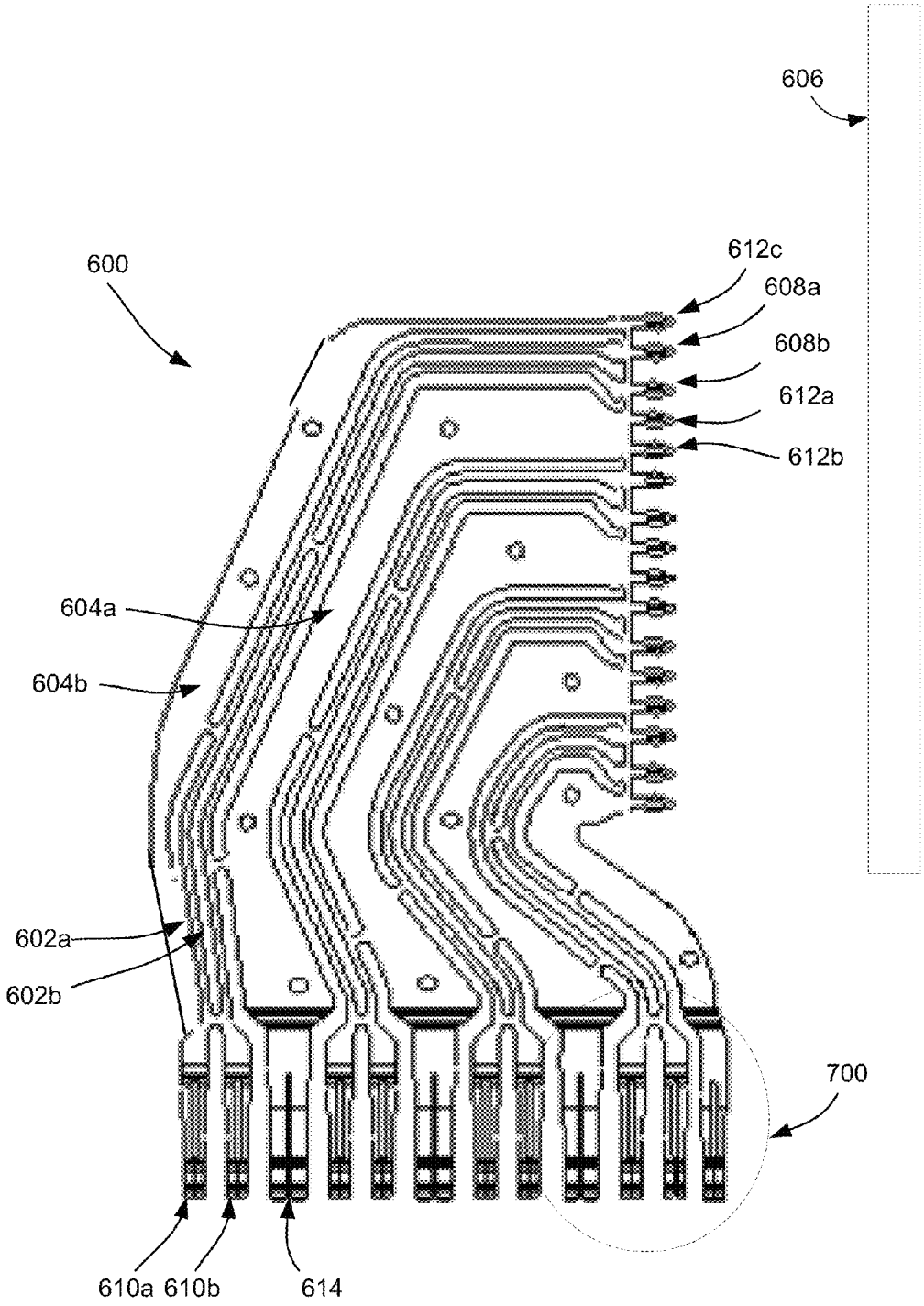
FIG. 6 is a top view of an illustrative second-type lead frame suitable for use in a wafer of the second-type connector of FIG. 1B, in accordance with some embodiments.

FIG. 6 is a top view of an illustrative second-type lead frame 600. Such a lead frame illustrates construction techniques suitable for use in forming a connector to mate with connector 500. In this example, lead frame 600 has four pairs of signal conductors. It may be appreciated that a lead frame 600 may be formed with any suitable number of pairs of signal conductors. For example, FIG. 5 shows rows (orthogonal to columns 504 and 506) with three pairs of signal conductors. For use in a connector that mates with a connector as shown in FIG. 5, a lead frame 600 may be formed with three pairs of signal conductors.

Lead frame 600 may be used to form a wafer. The second-type lead frame 600 may be surrounded by an insulative housing (e.g., the insulative housing 120 of the second-type connector 116 shown in FIG. 1B), in accordance with some embodiments. In this example, the second-type lead frame 600 includes a plurality of conductive elements, such as conductive elements 602*a*, 602*b*, 604*a*, and 604*b*. In some embodiments, second-type lead frame 600 may be made by stamping a single sheet of metal to form the conductive elements, and may be enclosed in an insulative housing (e.g., insulative housing 120 of FIG. 1B) to form a wafer suitable for use in a second-type connector.

In some embodiments, separate conductive elements may be formed in a multi-step process. For example, it is known in the art to stamp multiple lead frames from a strip of metal and then mold an insulative material forming a housing around portions of the conductive elements, thus formed. To facilitate handling, though, the lead frame may be stamped in a way that leaves tie bars between adjacent conductive elements to hold those conductive elements in place. Additionally, the lead frame may be stamped with a carrier strip, and tie bars between the carrier strip and conductive elements. After the housing is molded around the conductive elements, locking them in place, a punch may be used to sever the tie bars. Such processes may be used to manufacture the second type lead frame 600 and/or the first type lead frame 300.

Each conductive element of the illustrative second-type lead frame 600 may have one or more contact tails at one end and a mating portion at the other end. As discussed above in connection with FIG. 3A, the contact tails may be adapted to be attached to a printed circuit board or other substrate, such as PCB 606, to make electrical connections with corresponding conductive elements of the substrate. The mating portions may be adapted to make electrical connections to corresponding mating portions of a mating connector (e.g., the first-type connector 100 shown in FIG. 1A).

In the embodiment shown in FIG. 6, some conductive elements, such as first-type conductive elements 602*a* and 602*b*, are adapted for use as signal conductors. In this example, the signal conductors are configured as an edge coupled differential pair. Each signal conductor of a differential pair may be relatively narrow. As such, the first type conductive elements 602*a* and 602*b* may have only one contact tail each, respectively, contact tail 608*a* and contact tail 608*b*.

Also, each of the first type conductive elements 602*a* and 602*b* may have a mating portion, such as mating portion 610*a* for the first type conductive element 602*a*, and mating portion 610*b* for the first type conductive element 602*b*. Each of the mating portions may electrically couple with mating portions of conductive elements from a mated connector, such as first-type connector 100 in FIG. 1B. Although the example in FIG. 6 shows four such pairs of mating portions, corresponding to four pairs of signal conductors, the present disclosure is not limited to this number. In general, the number of signal conductor pairs used in second-type lead frame 600 may be designed to be compatible with the number of wafers having first-type lead frames in the mating first-type connector. For example, in some embodiments, a second-type lead frame may have three pairs of signal conductors, to be compatible with mating portions in the first-type lead frames 300 and 400 of FIGS. 3A and 4A.

In some embodiments, the mating portion of each signal conductor may have a dual-beam structure. For example, in FIG. 6, the mating portion 610*a* of first-type conductor 602*a* may have two parallel beams of the same length. Similarly, the mating portion 610*b* of first-type conductor 604*a* may have a dual-beam structure.

In some embodiments, mating portions 610*a* and 610*b* may each comprise a multi-beam structure using beams of different lengths. For example, each of mating portions 610*a* and 610*b* may have a triple beam structure, with two parallel beams integrally formed with the conductive member and a third beam fused to the conductive member (not shown in FIG. 6). The two parallel beams may be the same length. The third beam may be shorter. Such a structure is shown in greater detail, for example, in FIGS. 8B and 8C.

In the embodiment shown in FIG. 6, other conductive elements, such as second-type conductive elements 604*a* and 604*b*, are adapted for use as ground conductors. Some of the ground conductors may be relatively wide and therefore it may be desirable to provide multiple contact tails. In the example of FIG. 6, second-type conductive element 604*a* has contact tails 612*a* and 612*b*, and second-type conductive element 604*b* has contact tail 612*c*.

The second-type conductive elements 604*a* and 604*b* may also have mating portions, such as mating portion 614 for second-type conductive element 604*a*. The mating portion 614 may be compatible with a third-type conductive element in a conductive member (e.g., third-type conductive element 512*a* in conductive member 502 of FIG. 5).

Again, it should be appreciated that while several examples of contact tails and mating portions have been discussed in regards to a second-type lead frame of FIG. 6, other numbers of contact tails other types of mating portion structures may also be suitable for conductive elements. Other conductive elements in second-type lead frame 600, though not numbered, may similarly be shaped as signal conductors or ground conductors. Various inventive features relating to mating portions are described in greater detail below in connection with FIG. 7, which shows an enlarged view of the region of the second-type lead frame 600 indicated by the dashed circle 700 in FIG. 6.

Figure 7:
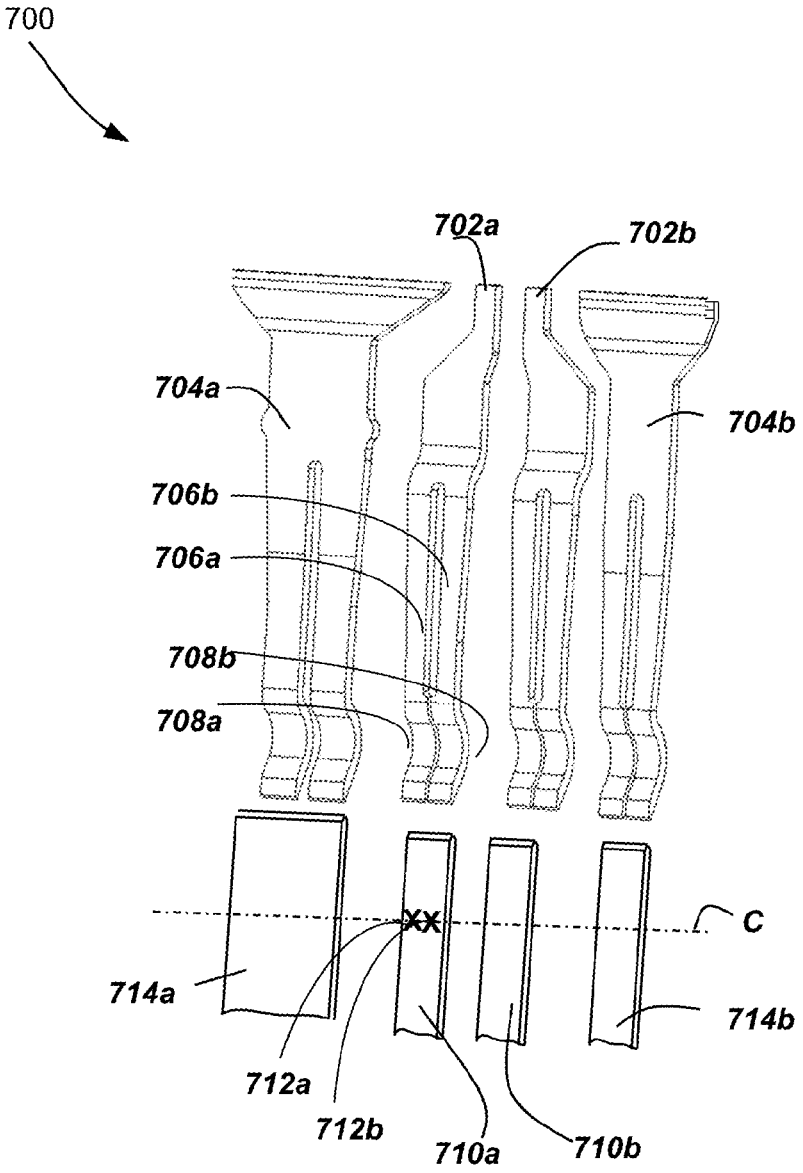
FIG. 7 is an enlarged, perspective view of region 700 of the illustrative second-type lead frame 600 shown in FIG. 6, showing a coupling with mating portions of a first-type lead frame, in accordance with some embodiments.

Turning now to FIG. 7, further detail of the features described above and additional features that may improve performance of a high speed connector are illustrated. FIG. 7 shows an enlarged perspective view of the region of the illustrative second-type lead frame 600 indicated by dashed circle 700 in FIG. 6, in accordance with some embodiments. As discussed above in connection with FIG. 6, the second-type lead frame 600 may be suitable for use in an insulative housing of a subassembly, such as a wafer, of a second-type connector (e.g., the insulative housing 120 of the second-type connector 116 shown in FIG. 1B). Though, similar construction techniques may be used in connectors of any suitable type.

The region 700 of the second-type lead frame shown in FIG. 7 includes a plurality of mating portions adapted to mate with corresponding mating portions in a first-type connector (e.g., the first-type connector 100 shown in FIGS. 1A and 1B). Some of these mating portions (e.g., mating portions 702*a*, 702*b*) may be associated with conductive elements designated as signal conductors, while some other mating portions (e.g., mating portions 704*a*, 704*b*) may be associated with conductive elements designated as ground conductors.

In the example shown in FIG. 7, each of the mating portions 702*a* and 702*b* includes two elongated beams. For instance, the mating portion 702*a* includes two elongated beams 706*a* and 706*b*. Furthermore, each of the mating portions 702*a* and 702*b* may include at least one mating surface adapted to be in electrical contact with a corresponding mating portion in a first-type connector. For example, in the embodiment shown in FIG. 7, the mating portion 702*a* has two mating surfaces near the distal end, namely, mating surface 708*a* of the beam 706*a* and mating surface 708*b* of the beam 706*b*. In this example, these mating surfaces are formed on convex portions of the beam and may be coated with gold or other malleable metal or conductive material resistant to oxidation.

Additionally, the mating portion 702*a* may have a third beam (not visible in FIG. 7), attached underneath the mating portion 702*a*. For example, the third beam may be attached by an appropriate technique, such as brazing, welding, and/or soldering. This third beam may have a mating surface with a convex portion that is displaced further away from the distal end than the convex portions of the beams 706*a* and 706*b*. As explained in greater detail below in connection with FIGS. 8B and 8C, such an additional third beam and contact portion may be used to short an unterminated stub of a corresponding mating portion in a first-type connector when the mating portion 702*a* is mated with the corresponding mating portion.

As such, the illustrative mating portion 702*a* may have three mating surfaces: mating surface 708*a* of the beam 706*a*, mating surface 708*b* of the beam 706*b*, and a third mating surface located on a third beam disposed below the pair of beams 706*a* and 706*b*. In the embodiment shown in FIG. 7, the mating portion 702*b* may be a mirror image of mating portion 702*a*, and may also have a third beam disposed below the two beams shown in FIG. 7.

The additional mating surface provided by a third beam may provide more tolerance for deviations in mating alignment between two connectors. Such deviations may be exacerbated in direct-connect systems, where there is no midplane or backplane to provide a rigid support. As such, alignment deviations in direct-connect architectures may be almost twice as large as deviations in midplane or backplane systems.

As discussed above, it may be desirable to have ground conductors that are relatively wide and signal conductors that are relatively narrow. However, expanding the width of the ground conductors can increase the size of the electrical connector in a dimension along the column. In some embodiments, it may be desirable to limit the dimension of the electrical connector in a dimension along the columns of signal conductors.

One approach to limiting the width of the connector is, as shown in FIG. 7, to make mating contacts at an end of a column, such as mating portion 704*b*, narrower than other mating portions in the column, such as mating portion 704*a*. The narrower mating portion 704*b* may otherwise be formed with the same shape as mating portion 704*a*. Furthermore, it may be desirable to keep signal conductors of a pair that is designated as a differential pair running close to each other so as to improve coupling and/or establish a desired impedance.

As shown in FIG. 7, mating portions 702*a* and 702*b* are aligned to fall in a column C of mating portions in a second-type connector. Also aligned with mating portions 702*a* and 702*b* in column C are mating portions 704*a* and 704*b*, which may form the mating portions of ground conductors within the second-type connector. The illustrated configuration positions a ground conductor in the column on both sides of mating portions 702*a* and 702*b*. Mating portion 704*b* is, in the embodiment illustrated, narrower than mating portion 704*a*.

As shown, mating portion 702*a* has two beams 706*a* and 706*b*. Each of these beams has a mating surface 708*a* and 708*b*, respectively. When an electrical connector containing mating surfaces 708*a* and 708*b* is mated with a complementary connector, mating portion 702*a* will make contact with a mating contact in the complementary connector at mating surfaces 708*a* and 708*b*. In the embodiment illustrated, the mating portion in the complementary connector is shown as signal conductor 710*a*. In this embodiment, signal conductor 710*a* is shown as a blade, such as may be used in a first-type connector (e.g., blades corresponding to mating portions 314 and 322 in the first-type connector 300 of FIG. 3B). However, the shape of the mating contact is not a limitation on the invention.

As shown, mating surfaces 708*a* and 708*b* contact the signal conductor 710*a* at contact points 712*a* and 712*b*, respectively. For the contact configuration shown in FIG. 7, contact points 712*a* and 712*b* are aligned in the direction of column C. To ensure that mating portion 702*a* makes reliable contact with signal conductor 710*a*, signal conductor 710*a* may be constructed to have a width along the column that is larger than the width of mating portion 702*a* at the mating interface. This additional width ensures that, even with misalignment between a second-type connector holding mating portion 702*a* and *a* first-type connector holding signal conductor 710*a*, both mating surfaces 708*a* and 708*b* will contact signal conductor 710*a*.

Similarly, the mating portion 702*b* may contact with signal conductor 710*b*. In some embodiments, signal conductors 710*a* and 710*b* may correspond to mating portions 314 and 322 of first-type lead frame 300 in FIG. 3B (or alternatively, the pair of mating portions 408 of first-type lead frame 400 in FIG. 4B). Furthermore, in some embodiments, the ground conductors 714*a* and 714*b* may correspond to third-type conductive elements that are directly attached to a conductive member coupling the first-type and second-type connectors. For example, the ground conductors 714*a* and 714*b* may be tabs that extend from a surface of the conductive member (e.g., ground blades 222*a*, 222*b*, 222*c* of FIG. 2 or ground blades 512*a*, 512*b*, 512*c* of FIG. 5).

Figure 8A:
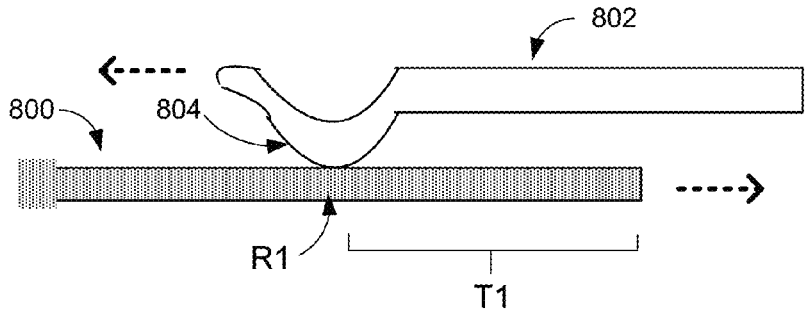
FIG. 8A is a side view of a coupling between mating portions of a first-type connector and a second-type connector, in accordance with some embodiments.

FIG. 8A is a side view of a mating portion 800 of a first-type connector (e.g., first-type connector 100 in FIG. 1B) and a mating portion comprising beam 802 of a second-type connector (e.g., second-type connector 116 in FIG. 1B), in accordance with some embodiments. There may be a second beam (not shown in FIG. 8A) parallel to beam 802, and the pair of beams may comprise a mating portion (e.g., beams 706*a* and 706*b* comprising the mating portion 702*a* of FIG. 7).

In this example, beam 802 has a mating surface 804 that is in the form of a "bump" protruding from below the beam 802, creating a convex portion to press against a mating contact. However, other types of mating surfaces may also be used, as aspects of the present disclosure are not limited in this regard.

FIG. 8A shows mating portion 800 fully mated with a corresponding mating portion comprising beam 802. For example, the mating portion 800 may be the blade 314 of the first-type lead frame 300 of FIG. 3A in a first-type connector 100 shown in FIG. 1B, while the beam 802 may be beam 706*b* of mating portion 702*a* of FIG. 7 in a second-type lead frame 600 of second-type connector 116 shown in FIG. 1B. The direction of relative motion of the mating portions during mating is illustrated by arrows, which is in the elongated dimension of the mating contacts.

In the illustrative configuration shown in FIG. 8A, a mating surface 804 of the beam 802 is in electrical contact with a contact region R1 of the mating portion 800. The portion of the mating portion 800 between the distal end and the contact region R1 is sometimes referred to as a "wipe" region.

In some embodiments, the contact region R1 may be at least a selected distance T1 away from the distal end of the mating portion 800, so as to provide a sufficiently large wipe region. This may help to ensure that adequate electrical connection is made between the mating portion 800 and the mating portion including beam 802, even if the mating portion 800 does not reach the contact region R1 due to manufacturing or assembly variances.

However, a wipe region may form an unterminated stub when electrical currents flow between the mating portion 800 and beam 802. The presence of such an unterminated stub may lead to unwanted resonances, which may lower the quality of the signals carried through the mating portion 800 and beam 802. Therefore, it may be desirable to reduce such an unterminated stub while still providing sufficient wipe to ensure adequate electrical connection.

In some embodiments, it may be desirable to provide signal and/or ground conductors with mating surfaces having multiple points of contact spaced apart in a direction that corresponds to an elongated dimension of the conductive element.

Accordingly, in the embodiment shown in FIG. 8B, an additional third beam 806 is provided below the beam 802. The third beam 806 may have a convex portion 808 that makes electrical contact with the mating portion 800 at a location (e.g., contact region R2) between the contact region R1 and the distal end of the mating portion 800. In this manner, a stub length is reduced from T1 (i.e., the distance between the contact region R1 and the distal end of the mating portion 800) to T2 (i.e., the distance between the contact region R2 and the distal end of the mating portion 800). This may reduce unwanted resonances and thereby improve signal quality.

The convex portion 808 of third beam 806 may be located farther away from the distal end of beam 802 than the convex portion 804. For example, the convex portion 808 may be a distance of at least 3 mm greater than the distance between the convex portion 804 and the distal end of beam 802. For example, in some embodiments, the distance may be in the range of 3 mm to 10 mm. In other embodiments, the distance may be in the range of 3.5 mm to 8.5 mm or 3.5 mm to 5 mm. In other example, the distance may be smaller such as between 1.0 mm and 3.5 mm or 0.5 mm to 2 mm. It should be appreciated, however, that the convex portion 808 may be located at any suitable distance from the distal end of beam 802, such that a contact region of the third beam 806 with the mating region 800 reduces the unterminated stub, while still providing sufficient wipe for an adequate electrical connection.

Figure 8B:
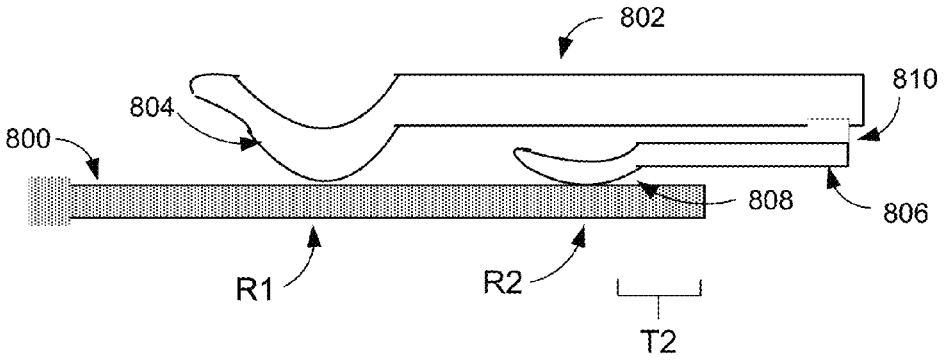
FIG. 8B is a side view of a coupling between mating portions of a first-type connector and a second-type connector with a third beam, when the mating portions are fully mated with each other, in accordance with some embodiments.

In some embodiments, the third beam 806 may be fused to a conductive member that is integrally formed with the beam 802 and a second beam parallel to beam 802 (not shown in FIG. 8B). For example, such a conductive member may be a lead frame comprising all three beams (e.g., lead frame 600 of FIG. 6). The third beam may be fused to the conductive member, for example, at a location 810, by any appropriate means, including means known in the art for attachment of metal components. For example, the third beam may be fused to the conductive member by techniques that comprise brazing, welding, and/or soldering. Though, the present disclosure is not limited to the third beam being fused to the conductive member, as the third beam may be created by any suitable method, including being integrally formed with the conductive member.

Figure 8C:
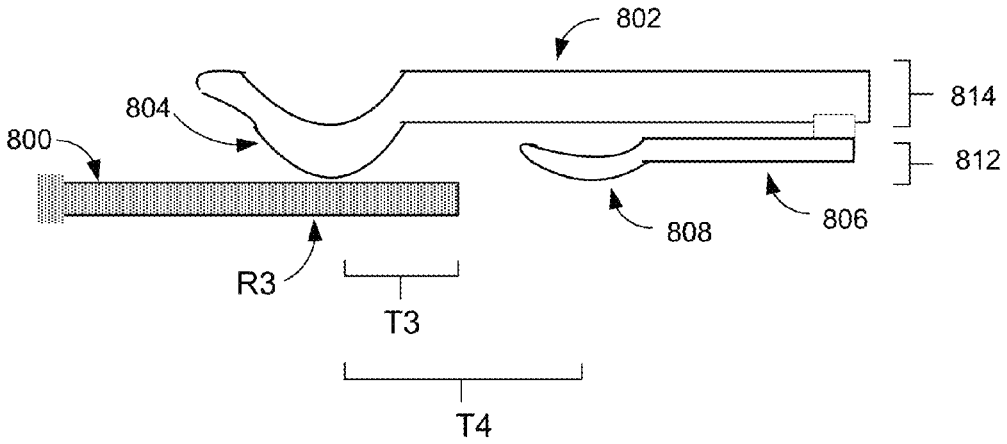
FIG. 8C is a side view of coupling between mating portions of a first-type connector and a second-type connector with a third beam, when the mating portions are partially mated with each other, in accordance with some embodiments.

FIG. 8C shows a side view of the mating portion 800 and beam 802 shown in FIG. 8B, but only partially mated with each other, in accordance with some embodiments. FIG. 8C illustrates how, despite deviations in mating alignment in a direction that corresponds to an elongated dimension of the conductive element, desirable mating characteristics may be achieved.

In this example, the convex portion 808 of the beam 802 does not reach the mating portion 800. This may happen, for instance, due to manufacturing or assembly variances. As a result, the beam 802 only reaches a contact region R3 of the mating portion 800, resulting in an unterminated stub of length T3 (i.e., the distance between the contact region R3 and the distal end of the mating portion 800). However, the length T3 is at most the distance T4 between the convex portions 804 and 808. This is because, if T3 were greater than T4, the convex portion 808 would have made electrical contact with the mating portion 800, thereby shorting the unterminated stub. Therefore, a stub length may be limited by positioning the third beam 806 such that its convex portion 808 is at an appropriate location along the beam 802 so that the convex portions 804 and 808 are no more than a selected distance apart.

In some embodiments, the distance T4 between the convex portion 804 of the main contact beam 802 and convex portion 808 of the third contact beam 806 may be between 10% and 50% of the length of the main contact beam 802. In some embodiments, the distance T4 may be between 20% and 40% of the length of beam 802. As a specific example, the distance T4 may be between 25% and 35% of the length of main contact beam 802.

As discussed above, a contact force may be desirable to press together two conductive elements at a mating interface so as to form a reliable electrical connection. Accordingly, in some embodiments, mating portions of a second-type connector (e.g., the mating portion comprising beam 802 shown in FIGS. 8A-C) may be relatively compliant, whereas corresponding mating portions of a first-type connector (e.g., the mating portion 800 shown in FIGS. 8A-C) may be relatively rigid. When the first-type connector and the second-type connector are mated with each other, a mating portion of the second-type connector may be deflected by the corresponding mating portion of the first-type connector, thereby generating a spring force that presses the mating portions together to form a reliable electrical connection.

In some embodiments, the third beam 806 may have a different thickness (or width) than the beam 802. For example, the third beam may have a thickness 812 that is less than a thickness 814 of beam 802. As such, the third beam 806 may be deflected by a greater percentage of its length than beam 802 and still generate the same or lower contact force. For example, third beam 806 may have a thickness that is 25% to 75% the thickness of beam 802. Though, in some embodiments, the thicknesses of the third beam 806 can be the same as the thickness of the beam 802, as the present disclosure is not limited in this regard. Alternatively or additionally, the third beam 806 may have a different contact resistance than beam 802, which may be larger. For example, the main contact beam 802 may have a contact resistance less than 5 Ohms, while the third beam 806 may have a contact resistance greater than 10 Ohms, and as a specific example, between 20 Ohms and 40 Ohms.

It should be appreciated that FIGS. 8B and 8C illustrate how a contact structure may be used to eliminate an unterminated stub in a signal conductor. Eliminating unterminated stubs may avoid reflections that may contribute to near end cross talk, increase insertion loss or otherwise impact propagation of high speed signals through a connector system.

Although specific examples of mating surfaces and arrangements thereof are shown in FIGS. 8A-C and described above, it should be appreciated that aspects of the present disclosure are not limited to any particular types or arrangements of mating surfaces. For example, more or fewer convex portions may be used on each mating portion, and the location of each convex region may be varied depending on a number of factors, such as desired mechanical and electrical properties, and manufacturing variances.

Various inventive concepts disclosed herein are not limited in their applications to the details of construction and the arrangements of components set forth in the following description or illustrated in the drawings. Such concepts are capable of other embodiments and of being practiced or of being carried out in various ways. Also, the phraseology and terminology used herein is for the purpose of description and should not be regarded as limiting. The use of "including," "comprising," "having," "containing," and "involving," and variations thereof, is meant to encompass the items listed thereafter and equivalents thereof as well as possible additional items.

Having thus described several inventive concepts of the present disclosure, it is to be appreciated that various alterations, modifications, and improvements will readily occur to those skilled in the art.

For example, portions of the connectors described above may be made of insulative material. Any suitable insulative material may be used, include those known in the art. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to some embodiments of the invention. One or more fillers may be included in some or all of the binder material used to form insulative housing portions of a connector. As a specific example, thermoplastic PPS filled to 30% by volume with glass fiber may be used.

As another example, techniques are described as applied to a direct connect orthogonal connector system. The described techniques may be used in any suitable connectors, such as backplane connectors, right angle connectors, mezzanine connectors, cable connectors or chip sockets.

As an example of another variation, a multi-beam mating contact structure was described as having a dual beam configuration with an additional, shorter beam fused to fit dual beams. However, it should be appreciated that a shorter additional beam may be fused onto a single beam or a contact of any other suitable shape, which need not be a beam-shaped contact. Alternatively, a longer additional beam may be fused to a single beam, dual beam or contact of any other suitable shape.

Further, the additional beam is illustrated by embodiments in which the additional beam is fused to a conductive elements acting as a signal conductor. An additional beam may alternatively or additionally be fused to a conductive elements acting as a ground conductor.

As yet a further example of a variation, the additional beam is, in some embodiments, described as fused to another member acting as a mating contact for a conductive element in the connector. However, any suitable attachment mechanism may be used. In the described embodiments, fusing an additional beam allows different mechanical properties for different beams of the same conductive element and leads to a dense contact structure. Though, in other embodiments, the "additional beam" may be integrally formed with the rest of the mating portion of the conductive element, such as by stamping and folding operations.

Such alterations, modifications, and improvements are intended to be within the spirit of the inventive concepts of the present disclosure. Accordingly, the foregoing description and drawings are by way of example only.

What is claimed is:

1. An electrical connector, comprising:

a plurality of conductive elements, each of the plurality of conductive elements comprising a mating portion adjacent a distal end of the conductive element, the mating portion comprising:

a first beam extending in a first direction;

a second beam parallel to the first beam, each of the first beam and the second beam comprising a mating surface; and a third beam comprising a mating surface, the third beam being shorter than the first beam and the second beam, wherein:

the mating surfaces of the first beam, the second beam and the third beam face in the same direction, perpendicular to the first direction; and for each of the plurality of conductive elements, the first beam and second beam are integrally formed with a conductive member; and the third beam is fused to the conductive member.

2. An electrical connector, comprising:

a plurality of conductive elements, each of the plurality of conductive elements comprising a mating portion adjacent a distal end of the conductive element, the mating portion comprising:

a first beam;

a second beam parallel to the first beam, each of the first beam and the second beam comprising a mating surface; and a third beam comprising a mating surface, the third beam being shorter than the first beam and the second beam, wherein the mating surfaces of the first beam, the second beam and the third beam face in the same direction, wherein:

the each of the first beam and the second beam has a first thickness; and the third beam has a second thickness, the second thickness is less than the first thickness.

3. The electrical connector of claim 1, wherein:

the third beam is fused to the conductive member by brazing.

4. The electrical connector of claim 1, wherein:

the third beam is fused to the conductive member by welding.

5. The electrical connector of claim 1, wherein:

the third beam is fused to the conductive member by soldering.

6. The electrical connector of claim 1, wherein:

each of the plurality of conductive elements further comprises a contact tail and an intermediate portion joining the contact tail and the mating portion.

7. An electrical connector, comprising:

a plurality of conductive elements, each of the plurality of conductive elements comprising a mating portion adjacent a distal end of the conductive element, the mating portion comprising:

a first beam;

a second beam parallel to the first beam, each of the first beam and the second beam comprising a mating surface; and a third beam comprising a mating surface, the third beam being shorter than the first beam and the second beam, wherein:

each of the plurality of conductive elements further comprises a contact tail and an intermediate portion joining the contact tail and the mating portion;

the plurality of conductive elements are disposed in a plurality of sets; and the electrical connector further comprises a plurality of housings, with intermediate portions of the conductive elements of each of the plurality of sets held within the same housing of the plurality of housings.

8. The electrical connector of claim 1, wherein:

the mating surface of the first beam comprises a surface of a convex portion of the first beam;

the mating surface of the second beam comprises a surface of a convex portion of the second beam; and the mating surface of the third beam comprises a surface of a convex portion of the third beam.

9. The electrical connector of claim 8, wherein:

for each of the plurality of conductive elements:

each of the plurality of conductive elements comprises a distal end;

the convex portion of the first beam and the convex portion of the second beam are a first distance from the distal end; and the convex portion of the third beam are a second distance from the distal end, the second distance being greater than the first distance.

10. The electrical connector of claim 9, wherein:

the second distance is greater than the first distance by at least 3 mm.

11. The electrical connector of claim 1, wherein:

the plurality of conductive elements are first-type conductive elements;

the electrical connector comprises a plurality of second-type conductive elements;

the mating portions of the plurality of conductive elements are disposed in a plurality of columns, each column comprising a plurality of pairs of first-type conductive elements with a second type conductive element disposed between adjacent pairs of first-type conductive elements.

12. The electrical connector of claim 11, wherein:

the first type conductive elements are signal conductors; and the second type conductive elements are ground conductors.

13. The electrical connector of claim 1, wherein each of the mating surfaces is plated with gold.

14. A method of manufacturing an electrical connector, the method comprising:

stamping a lead frame, the lead frame comprising a plurality of first-type conductive elements, each of the first-type conductive elements comprising a mating portion comprising at least one beam having a mating surface; and subsequently attaching to each of the first-type conductive elements a second type conductive element, the second type conductive element comprising at least one beam and comprising a mating surface, wherein the mating surfaces of the at least one beam of the first type conductive elements and the at least one beam of the second type conductive elements face in the same direction.

15. The method of claim 14, wherein:

attaching comprises brazing, welding or soldering.

16. The method of claim 14, further comprising coating the mating portion of at least the first-type conductive elements with gold.

17. The method of claim 14, wherein:

the second-type conductive element is shorter than the first-type conductive element.

18. The method of claim 14, wherein:

stamping the lead frame comprises stamping the lead frame with third-type conductive elements between pairs of first-type conductive elements, the third-type conductive elements being wider than the first-type conductive elements.

* * * * *